US010913566B2

(12) United States Patent
Exner et al.

(10) Patent No.: US 10,913,566 B2
(45) Date of Patent: Feb. 9, 2021

(54) STACKABLE CARTONS, SYSTEM, AND METHODS OF USING THE SAME

(71) Applicant: Graphic Packaging International, LLC, Atlanta, GA (US)

(72) Inventors: Dana Exner, Wheaton, IL (US); Aaron Bates, Kennesaw, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 42 days.

(21) Appl. No.: 16/281,434

(22) Filed: Feb. 21, 2019

(65) Prior Publication Data

US 2019/0256241 A1 Aug. 22, 2019

Related U.S. Application Data

(60) Provisional application No. 62/643,911, filed on Mar. 16, 2018, provisional application No. 62/633,157, filed on Feb. 21, 2018.

(51) Int. Cl.

| | |
|---|---|
| ***B65D 5/46*** | (2006.01) |
| ***B65D 21/02*** | (2006.01) |
| ***B65D 5/00*** | (2006.01) |
| *B65D 5/40* | (2006.01) |
| *B65D 25/22* | (2006.01) |

(52) U.S. Cl.

CPC ..... *B65D 5/003* (2013.01); *B65D 5/46024* (2013.01); *B65D 5/40* (2013.01); *B65D 21/0219* (2013.01); *B65D 21/0226* (2013.01); *B65D 25/22* (2013.01); *B65D 2525/285* (2013.01)

(58) Field of Classification Search

CPC ..... B65D 5/46032; B65D 5/46008; B65D 5/0015; B65D 5/003; B65D 5/2052; B65D 5/443; B65D 5/0245

USPC ..... 229/122.32, 114.11, 117.19, 117.25, 229/117.26, 232, 125.19, 125.27, 141, 229/149, 902–906, 143, 147, 174

See application file for complete search history.

(56) References Cited

U.S. PATENT DOCUMENTS

| | | | |
|---|---|---|---|
| 396,570 A | 1/1889 | Hotchkiss | |
| 637,838 A | 11/1899 | Vernon | |

(Continued)

FOREIGN PATENT DOCUMENTS

| | | | |
|---|---|---|---|
| CA | 1079240 | 6/1980 | |
| FR | 3008386 B1 * | 4/2016 | ..... B65D 5/665 |

(Continued)

OTHER PUBLICATIONS

FR-3008386 English Machine Translation (Year: 2016).*

(Continued)

*Primary Examiner* — Nathan J Newhouse
*Assistant Examiner* — Phillip D Schmidt
(74) *Attorney, Agent, or Firm* — Womble Bond Dickinson (US) LLP

(57) ABSTRACT

A carton for holding at least one article includes a plurality of panels extending at least partially around an interior of the carton. The plurality of panels includes a top panel, a bottom panel, a front panel, a back panel, and at least one side panel. The top panel is recessed below a portion of each of the front panel, the back panel, and the at least one side panel to form a recessed top portion for receiving a portion of a vertically adjacent carton.

68 Claims, 17 Drawing Sheets

(56) References Cited

U.S. PATENT DOCUMENTS

| | | | | |
|---|---|---|---|---|
| 1,373,365 | A | 3/1921 | Smouse | |
| 1,892,756 | A | 1/1933 | Home | |
| 2,330,521 | A | 9/1943 | Scheide | |
| 2,341,762 | A | 2/1944 | Conklin | |
| 2,355,729 | A | 8/1944 | Inman | |
| 2,355,730 | A | 8/1944 | Inman | |
| 2,926,782 | A * | 3/1960 | Noble | B65D 71/285 206/142 |
| 3,027,063 | A | 3/1962 | Zastrow | |
| 3,324,999 | A | 6/1967 | Farquhar | |
| 3,355,089 | A | 11/1967 | Champlin | |
| 3,447,735 | A | 6/1969 | Whitney | |
| D217,441 | S | 5/1970 | Kanaga | |
| 3,840,172 | A | 10/1974 | Zimmermann | |
| 3,886,901 | A | 6/1975 | Zeitter | |
| 3,949,928 | A | 4/1976 | Perkins | |
| 4,068,795 | A | 1/1978 | Forster | |
| 4,277,015 | A | 7/1981 | Crane | |
| 4,328,923 | A | 5/1982 | Graser | |
| 4,340,169 | A | 7/1982 | Webinger | |
| 4,449,633 | A | 5/1984 | Johnson et al. | |
| 5,016,813 | A | 5/1991 | Simons | |
| 5,094,359 | A | 3/1992 | DeMars et al. | |
| 5,125,565 | A | 6/1992 | Rogers | |
| 5,170,934 | A | 12/1992 | Lemoine | |
| 5,292,058 | A | 3/1994 | Zoss et al. | |
| 5,294,044 | A | 3/1994 | Clark | |
| 5,307,986 | A | 5/1994 | Schuster | |
| 5,388,758 | A | 2/1995 | Scovell | |
| 5,411,204 | A | 5/1995 | Demay | |
| 5,520,284 | A * | 5/1996 | Gray | B65D 5/001 206/509 |
| 5,522,538 | A | 6/1996 | Gray | |
| 6,041,997 | A | 3/2000 | Jensen | |
| 6,126,065 | A | 10/2000 | Wee | |
| 6,298,992 | B1 * | 10/2001 | Tsao | B65D 71/48 206/194 |
| 6,299,059 | B1 * | 10/2001 | Bernstein | B65D 5/4279 229/115 |
| D458,127 | S | 6/2002 | De Groote | |
| D467,499 | S | 12/2002 | Garza et al. | |
| D473,787 | S | 4/2003 | Jones, Jr. et al. | |
| D484,043 | S | 12/2003 | Hwang et al. | |
| 6,676,010 | B1 | 1/2004 | Roseth et al. | |
| D519,366 | S | 4/2006 | Epstein | |
| 7,021,525 | B2 | 4/2006 | Jouppi et al. | |
| D519,830 | S | 5/2006 | Yocum | |
| D561,023 | S | 2/2008 | Jacxsens | |
| 7,552,820 | B2 | 6/2009 | Kohler | |
| 7,669,755 | B2 | 3/2010 | Smalley | |
| 7,699,214 | B2 | 4/2010 | Mestre et al. | |
| D630,508 | S | 1/2011 | Hubbard, Jr. | |
| D631,741 | S | 2/2011 | Hubbard, Jr. | |
| D631,742 | S | 2/2011 | Hubbard, Jr. | |
| D631,743 | S | 2/2011 | Hubbard, Jr. | |
| 7,938,257 | B2 | 5/2011 | Kohler | |
| D666,830 | S | 9/2012 | Glenn | |
| D684,858 | S | 6/2013 | Sill | |
| 8,740,050 | B2 | 6/2014 | Zinck et al. | |
| 8,770,466 | B1 * | 7/2014 | Terlesky | B65D 5/48018 229/120.13 |
| D717,162 | S | 11/2014 | Baker | |
| 9,169,037 | B2 | 10/2015 | Pinkstone | |
| D753,994 | S | 4/2016 | Pantelleria | |
| 9,309,023 | B2 | 4/2016 | Hubbard, Jr. | |
| D755,624 | S | 5/2016 | Ng | |
| 9,346,234 | B2 | 5/2016 | Hajek et al. | |
| D762,468 | S | 8/2016 | Pantelleria et al. | |
| D769,114 | S | 10/2016 | Montemayor | |
| 9,505,516 | B2 | 11/2016 | Hubbard, Jr. | |
| D775,947 | S | 1/2017 | Epstein | |
| 9,540,132 | B1 * | 1/2017 | Lee | B65D 5/0245 |
| 9,701,438 | B2 | 7/2017 | Fitzwater et al. | |
| D805,894 | S | 12/2017 | Lee | |
| D811,875 | S | 3/2018 | Haen et al. | |
| D813,029 | S | 3/2018 | Borkovetz et al. | |
| 10,017,290 | B2 | 7/2018 | Faulkner et al. | |
| 10,086,972 | B2 | 10/2018 | Hajek | |
| 10,232,973 | B2 | 3/2019 | Burke | |
| 10,239,651 | B2 | 3/2019 | Exner et al. | |
| 2004/0031842 | A1 | 2/2004 | Westerman et al. | |
| 2004/0182916 | A1 | 9/2004 | Roseth | |
| 2005/0218202 | A1 * | 10/2005 | Braoudakis | B65D 5/22 229/178 |
| 2005/0279815 | A1 | 12/2005 | Fogle et al. | |
| 2006/0255105 | A1 | 11/2006 | Sweet | |
| 2007/0095881 | A1 | 5/2007 | Manaige | |
| 2008/0087679 | A1 | 4/2008 | Cook | |
| 2009/0039144 | A1 | 2/2009 | Hooi et al. | |
| 2011/0308991 | A1 * | 12/2011 | Hubbard | B65D 5/2047 206/557 |
| 2012/0111931 | A1 * | 5/2012 | Kimhi | B65D 85/36 229/120 |
| 2014/0263600 | A1 | 9/2014 | Valencia | |
| 2017/0008661 | A1 * | 1/2017 | Flatley | B65D 5/46008 |

FOREIGN PATENT DOCUMENTS

| | | |
|---|---|---|
| JP | 2004-123101 | 4/2004 |
| JP | 2009-073536 | 4/2009 |
| KR | 20-0171748 Y1 | 3/2000 |
| WO | WO 89/10308 | 11/1989 |

OTHER PUBLICATIONS

International Search Report and Written Opinion for PCT/US2019/018914 dated Jun. 7, 2019.

Colpac Vizione Cardboard Food Tray. [online] Published on Apr. 20, 2017. Retrieved Dec. 18, 2018 from URL: http://www.castawayfoodpackaging.co.nz/product/01viztfl-vizione-cardboard-food-tray/.

* cited by examiner

STACKABLE CARTONS, SYSTEM, AND METHODS OF USING THE SAME

CROSS-REFERENCE TO RELATED APPLICATION

This application claims the benefit of each of U.S. Provisional Patent Application No. 62/633,157, which was filed on Feb. 21, 2018, and U.S. Provisional Patent Application No. 62/643,911, which was filed on Mar. 16, 2018.

INCORPORATION BY REFERENCE

The disclosures of each of U.S. Provisional Patent Application No. 62/633,157, which was filed on Feb. 21, 2018, and U.S. Provisional Patent Application No. 62/643,911, which was filed on Mar. 16, 2018, are hereby incorporated by reference for all purposes as if presented herein in their entirety.

BACKGROUND OF THE DISCLOSURE

The present disclosure relates to stackable cartons, systems of stackable cartons, blanks for forming stackable cartons, and methods associated with cartons that are stackable. In one embodiment, the present disclosure relates to a system including a plurality of stacked cartons that are engageable by a handle.

SUMMARY OF THE DISCLOSURE

According to one aspect of the disclosure, a carton for holding at least one article comprises a plurality of panels extending at least partially around an interior of the carton, the plurality of panels comprising a top panel, a bottom panel, a front panel, a back panel, and at least one side panel. The top panel is recessed below a portion of each of the front panel, the back panel, and the at least one side panel to form a recessed top portion for receiving a portion of a vertically adjacent carton.

According to another aspect of the disclosure, a carton blank for forming a carton for holding at least one article comprises a plurality of panels for extending at least partially around an interior of the carton formed from the carton blank, the plurality of panels comprising a top panel, a bottom panel, a front panel, a back panel, and at least one side panel. The top panel is positionable below a portion of each of the front panel, the back panel, and the at least one side panel to form a recessed top portion of the carton formed from the carton blank for receiving a portion of a vertically adjacent carton.

According to another aspect of the disclosure, a method of forming a carton for holding at least one article comprises obtaining a carton blank comprising a plurality of panels comprising a top panel, a bottom panel, a front panel, a back panel, and at least one side panel. The method further comprises folding the plurality of panels at least partially around an interior of the carton such that the top panel is recessed below a portion of each of the front panel, the back panel, and the at least one side panel to form a recessed top portion for receiving a portion of a vertically adjacent carton.

According to another aspect of the disclosure, a system of cartons for holding at least one article comprises a first carton, the first carton comprising a plurality of panels extending at least partially around an interior of the first carton, the plurality of panels comprising a top panel, a bottom panel, a front panel, a back panel, and at least one side panel. The top panel is recessed below a portion of each of the front panel, the back panel, and the at least one side panel to form a recessed top portion. The system further comprises a second carton at least partially disposed in the recessed top portion of the first carton.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

Cartons according to the present disclosure can accommodate articles of numerous different shapes. For the purpose of illustration and not for the purpose of limiting the scope of the disclosure, the following detailed description describes articles such as food products, product packages, containers, bottles, cans, etc., that are at least partially disposed within the carton embodiments. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; composite materials; and the like, or any combination thereof.

Cartons according to the present disclosure can accommodate articles of any shape. For the purpose of illustration and not for the purpose of limiting the scope of the disclosure, the following detailed description describes beverage containers (e.g., aluminum beverage cans, glass bottles, polymeric or paperboard cups, etc.), food products (e.g., soups, salads, sandwiches, etc.), or product packages (e.g., pouches, sleeves, cups, etc.) as disposed within the carton embodiments. In this specification, the terms "lower," "bottom," "upper," and "top" indicate orientations determined in relation to fully erected and upright cartons. As described herein, cartons can be formed from blanks by overlapping multiple panels, portions, and/or end flaps. Such panels, portions, and/or end flaps may be designated herein in terms relative to one another, e.g., "first", "second", "third", etc., in sequential or non-sequential reference, without departing from the disclosure.

Figure 1:
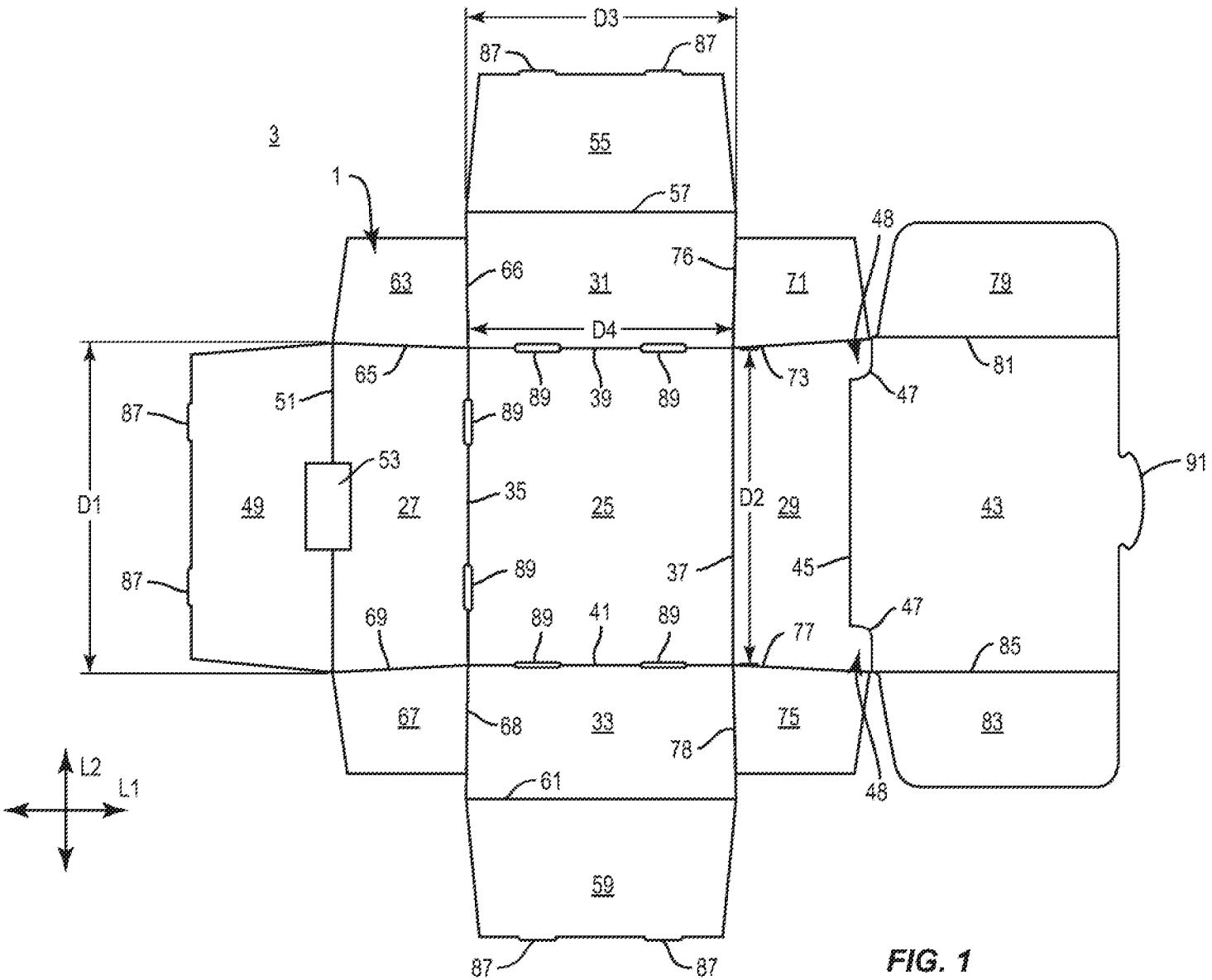
FIG. 1 is a plan view of an exterior surface of a blank for forming a carton according to a first exemplary embodiment of the disclosure.
Figure 2:
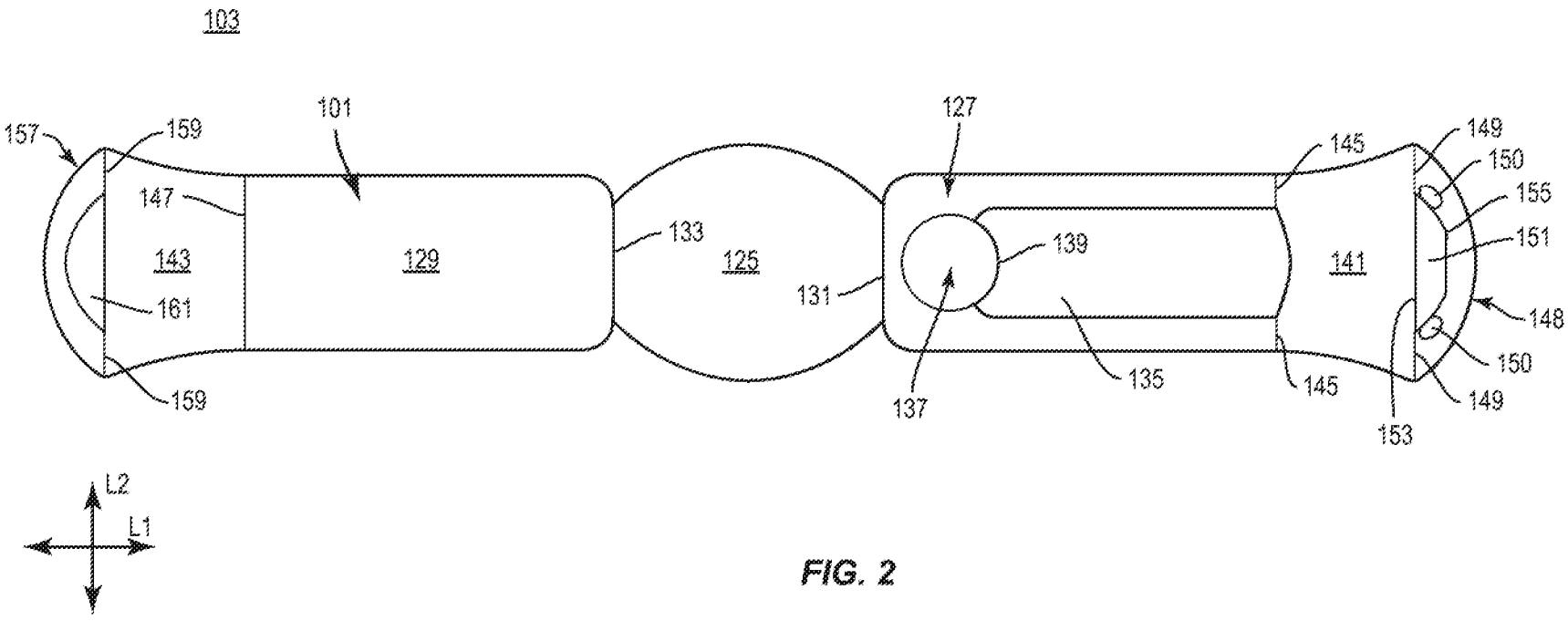
FIG. 2 is a plan view of an exterior surface of a blank for forming a handle according to the first exemplary embodiment of the disclosure.
Figure 4:
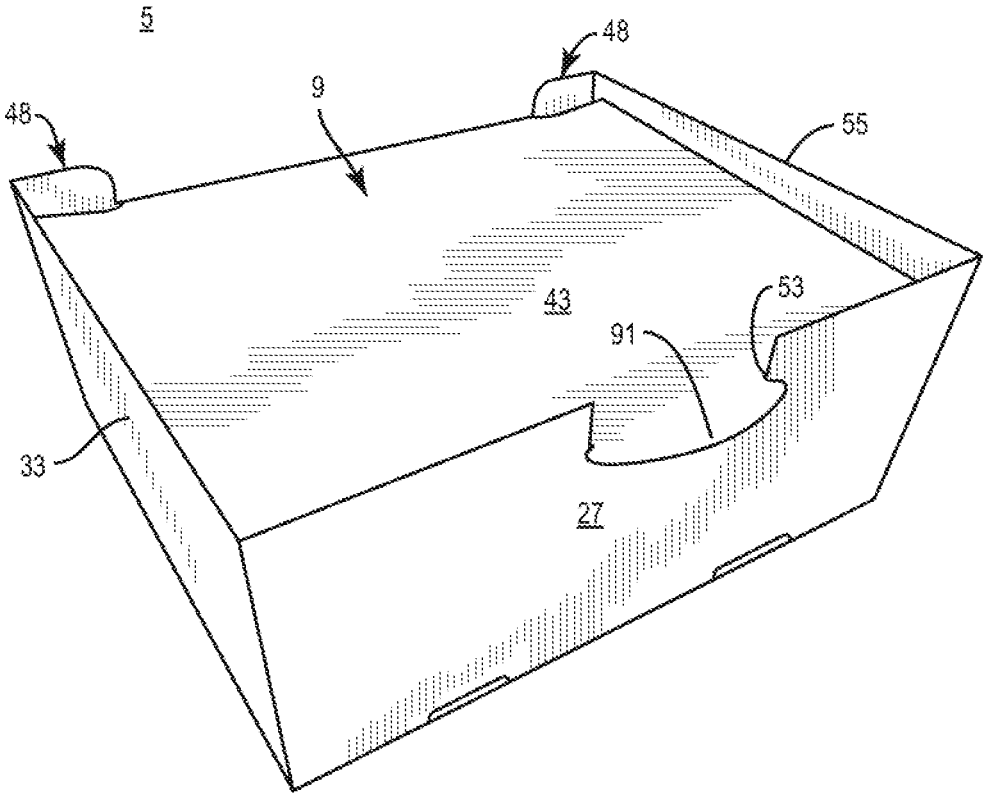
FIG. 4 is a perspective view of a carton formed from the blank of FIG. 1 and in a closed configuration according to the first exemplary embodiment of the disclosure.
Figure 4A:
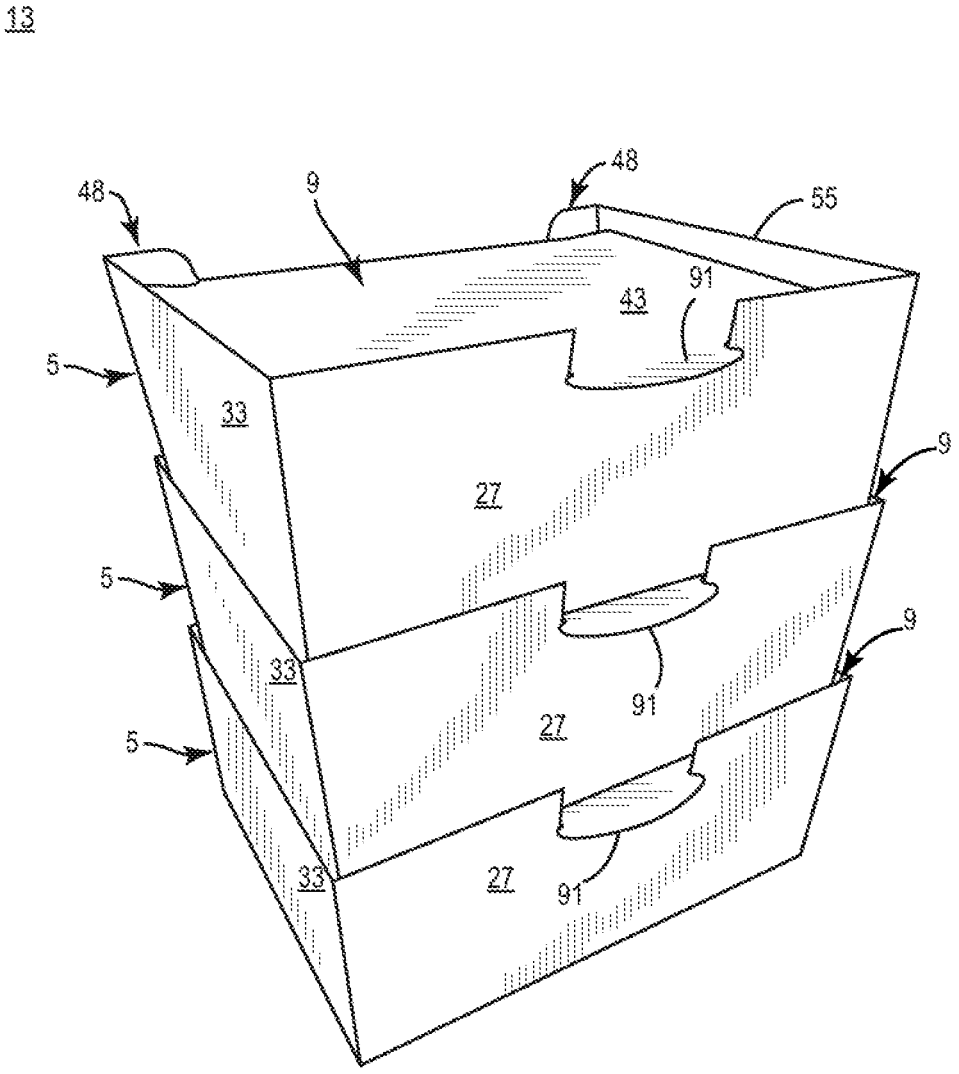
FIG. 4A is a perspective view of a system of stacked cartons each formed from the blank of FIG. 1 according to the first exemplary embodiment of the disclosure.
Figure 5:
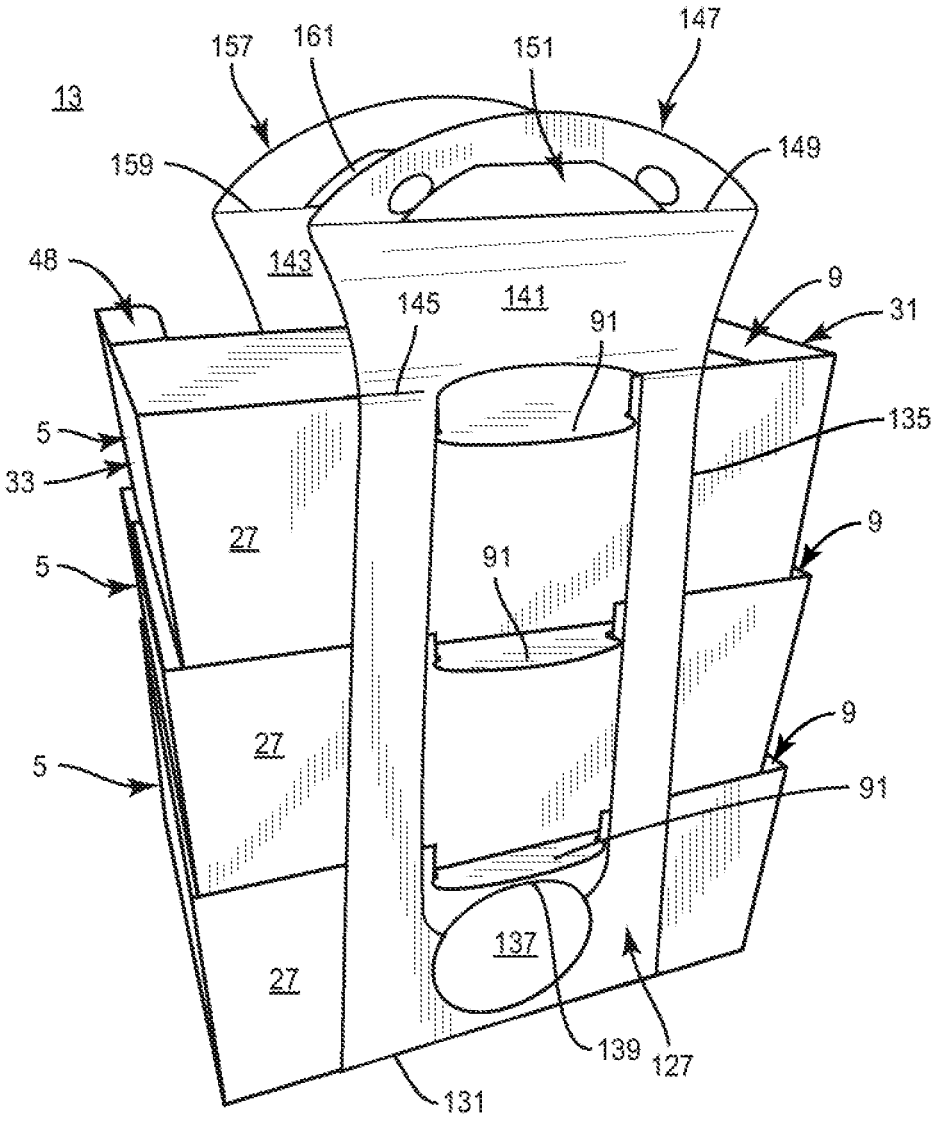
FIG. 5 is a perspective view of the system of FIG. 4A engaged by a handle formed from the blank of FIG. 2 according to the first exemplary embodiment of the disclosure.

FIG. 1 is a plan view of an exterior surface 1 of a carton blank 3 that can be obtained for forming a carton 5 (FIG. 4) according to a first exemplary embodiment of the disclosure. The carton 5 is provided to extend at least partially around an interior 7 (FIG. 3) for holding at least one article contained therein, for example, a food or beverage product or related packaging, and, as shown in FIG. 4, is provided with a recessed top portion 9 that receives a portion of another vertically stacked carton 5 to form a system 13 of multiple stacked cartons 5 can be provided (FIGS. 4A and 5). Referring additionally to FIG. 2, a blank 103 for forming a handle 11 that extends over at least the top panels 43 of multiple stacked cartons 5 of a system 13 is provided. In one embodiment, the handle 11 extends around the system 13 of stacked cartons 5 to carry the system 13 of stacked cartons 5. In one embodiment, the system 13 of stacked cartons 5 can be stacked and carried without the handle 11. Alternatively, the stacked cartons 5 and the handle 11 can together form the system 13 of stacked cartons 5. In another embodiment, the system of stacked cartons 5 can be engaged and/or carried by a different structure, for example, a bag, liner, or other packaging.

Still referring to FIG. 1, the blank 3, as shown, has a longitudinal axis L1 and a lateral axis L2. The illustrated blank 3 includes a bottom panel 25 that is foldably connected to a respective front panel 27, a back panel 29, a first side panel 31, and a second side panel 33 at respective fold lines 35, 37, 39, 41, with the fold lines 35, 37 being lateral fold lines and the fold lines 39, 41 being longitudinal fold lines. A top panel 43, as shown, is foldably connected to the back panel 29 at a lateral fold line 45 that extends between two curved cuts 47 that form respective upper edge portions 48 of the top panel 43. As shown, a front reinforcement panel 49 is foldably connected to the front panel 27 at a lateral fold line 51 that is interrupted by an opening 53 that is a discontinuity in the blank 3 that extends from a portion of the front panel 27 to a portion of the front reinforcement panel 49. A first side reinforcement panel 55, as shown, is foldably connected to the first side panel 31 at a longitudinal fold line 57, and a second side reinforcement panel 59 is foldably connected to the second side panel 33 at a longitudinal fold line 61.

In one embodiment, the illustrated blank 3 has a first front end flap 63 foldably connected to the front panel 27 at an oblique fold line 65 and a second front end flap 67 foldably connected to the front panel 27 at an oblique fold line 69. The respective end flaps 63, 67 are separated from the respective adjacent side panels 31, 33 by respective cuts 66, 68. Similarly, a first back end flap 71 is foldably connected to the back panel 29 at an oblique fold line 73 and a second back end flap 75 is foldably connected to the back panel 29 at an oblique fold line 77. The respective end flaps 71, 75 are separated from the respective adjacent side panels 31, 33 by respective cuts 76, 78. A first top end flap 79, as shown, is foldably connected to the top panel 43 at a longitudinal fold line 81 and a second top end flap 83 is foldably connected to the top panel 43 at a longitudinal fold line 85. The oblique fold lines 65, 69, 73, 77 could be longitudinal fold lines without departing from the disclosure.

With continued reference to FIG. 1, the blank 3 includes several features for facilitating formation into the carton 5 (FIG. 4). As shown, each of the front reinforcement panel 49, a free edge of each of the first side reinforcement panel 55, and the second side reinforcement panel 59 defines a pair of locking tabs or locking protrusions 87 that are configured for at least partial insertion into corresponding cuts or slits 89 that extend into the bottom panel 25 and interrupt respective portions of the respective fold lines 35, 39, and 41. As also shown, the top panel comprises a tab 91 protruding along a free edge of the top panel 43.

Figure 3:
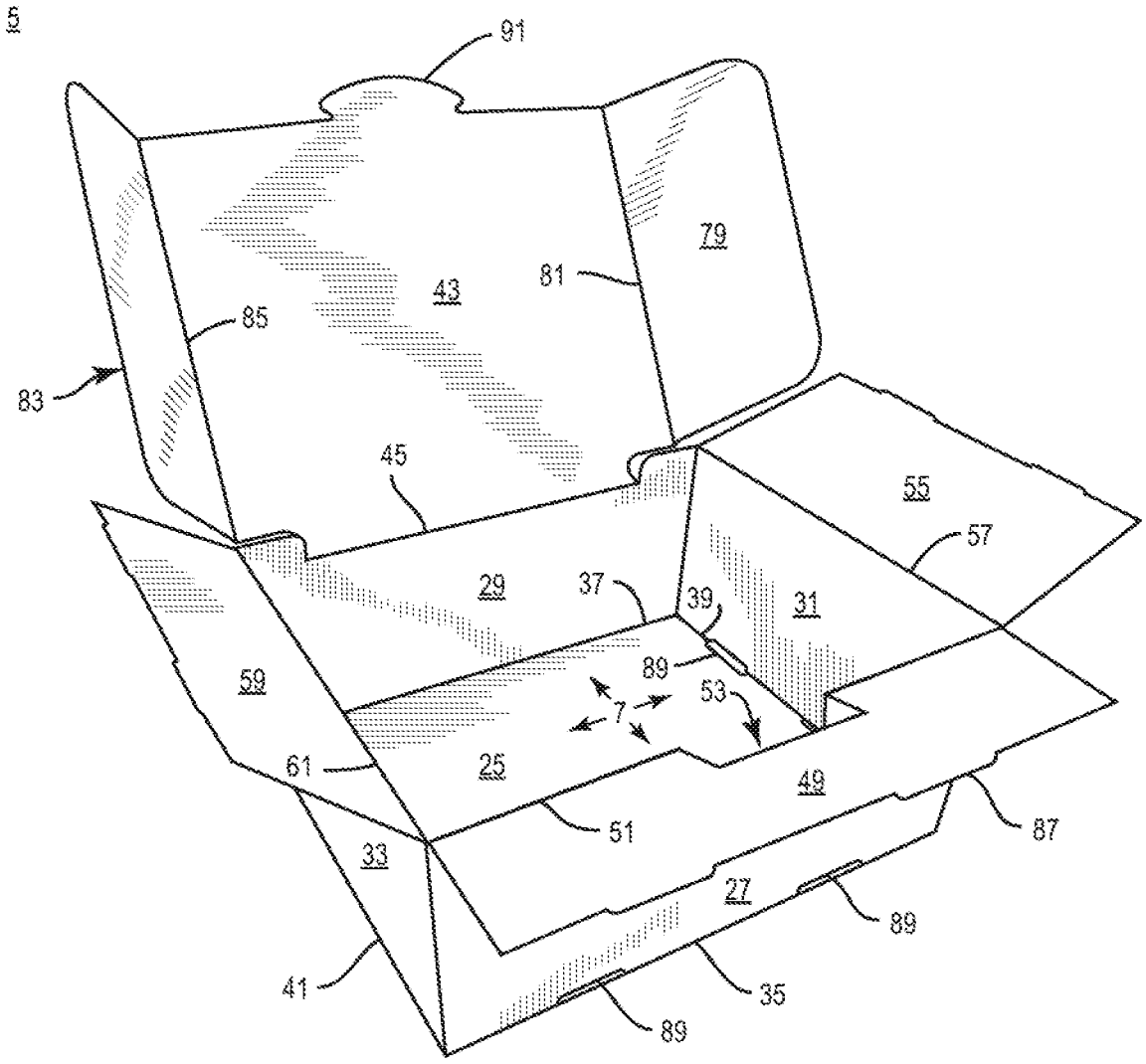
FIG. 3 is a perspective view of a partially formed carton formed from the blank of FIG. 1 according to the first exemplary embodiment of the disclosure.

Referring to FIGS. 1 and 3, the panels 49, 27, 25, 31, 33, 55, 59, 29, 43 can be folded around the interior 7 of the carton 5. In one embodiment, the front panel 27 is folded at the fold line 35 into a generally upright position relative to the bottom panel 25 and the front reinforcement panel 49 is folded downwardly at the fold line 51 into at least partial face-to-face contact with the interior surface of the front panel 27 such that the protrusions 87 of the front reinforcement panel 49 are positioned to be at least partially inserted into the slits 89 along the fold line 35. The back panel 29 can be folded at the fold line 37 into a generally upright position relative to the bottom panel 25, and the respective first and second side panels 31, 33 can be folded at the respective fold lines 39, 41 into a generally upright position relative to the bottom panel 25. The respective end flaps 63, 67 can be folded at the respective fold lines 65, 69 into at least partial face-to-face contact with the interior surface of the respective side panels 31, 33 and the respective end flaps 71, 75 can be folded at the respective fold lines 73, 77 into at least partial face-to-face contact with the interior surface of the respective side panels 31, 33. One or more of the end flaps 63, 71 and the end flaps 67, 75 can be adhered to the respective side panels 31, 33 with an adhesive such as glue. The first side reinforcement panel 55 can be folded downwardly at the fold line 57 into at least partial face-to-face contact with the end flaps 63, 71 and the interior surface of the first side panel 31 such that the protrusions 87 of the first side reinforcement panel 55 are positioned at least partially inserted into the slits 89 along the fold line 39. Similarly, the second side reinforcement panel 59 can be folded downwardly at the fold line 61 into at least partial face-to-face contact with the end flaps 67, 75 and the interior surface of the second side panel 33 such that the protrusions 87 of the second side reinforcement panel 59 are positioned at least partially inserted into the slits 89 along the fold line 41. The carton 5 can be assembled in a different order or configuration without departing from the disclosure.

In this regard, and with additional reference to FIG. 4, the carton 5 is provided with an openable configuration in which the top panel 43 is hingably attached to the back panel 29 and positionable between a closed position wherein the top panel 43 closes the interior 7 of the carton 5 and an open position wherein the top panel 43 is raised to provide access to the interior 7. In the illustrated closed configuration of the carton 5, the top panel 43 can be folded downwardly at the fold line 45, with the end flaps 79, 83 tucked into the interior 7 of the carton 5 adjacent the respective reinforcing panels 55, 59. As shown, the top panel 43 is arranged with the tab 91 resting upon portions of the front reinforcement panel 49 and the front panel 27 and engaging or extending through a notch formed by the opening 53. In this regard, the tab 91 presents a protruding surface for engagement by a user to open and reclose the carton 5. In the illustrated embodiment, the top panel 43 extends in generally planar relation adjacent upright upper portions of the front reinforcement panel 49 and the front panel 27, the first side reinforcement panel 55 and the first side panel 31, the second side reinforcement panel 59 and the second side panel 33, and the upper edge portions 48 of the back panel 29, all of which extend upwardly above the top panel 43 such that the top panel 43 is recessed therebelow to form the recessed top portion 9 of the carton 5.

In the illustrated embodiment, the front panel 27, the back panel 29, the first side panel 31, and the second side panel 33 have respective free edges that are positioned to be slightly oblique to (i.e., not perpendicular) and angled outwardly from the bottom panel 25 of the carton 5. In the carton 5 formed from the blank 3, the front panel 27, the back panel 29, the first side panel 31, and the second side panel 33 each have a respective bottom edge defined by a respective fold line 35, 37, 39, 41 connecting the respective panels 27, 29, 31, 33 to the bottom panel 25.

In the carton 5 formed from the blank 3, the front panel 27 has a top edge defined by the fold line 51 and the back panel 49 has a top edge defined by the fold line 45 and the cuts 47, each having a lateral length D1. The front panel 27 and the back panel 49 have respective bottom edges defined by the respective fold lines 35, 37, each having a lateral length D2. Further, the first side panel 31 and the second side panel 33 each have a respective top edge defined by a respective fold line 57, 61, each having a longitudinal length D3. The side panels 31, 33 have respective bottom edges defined by the respective fold lines 39, 41, each having a longitudinal length D4. In one embodiment, each of the front panel 27, the back panel 29, the first side panel 31, and the second side panel 33 have a respective top edge with the respective lengths D1, D3 that is greater than the respective lengths D2, D4 of the respective bottom edges so that the dimensions of the opening above the recessed top portion 9 that is formed by the top edges of the front panel 27, the back panel 29, the first side panel 31, and the second side panel 33 is larger than the dimensions of the bottom panel 25.

In this regard, the positioning of the front panel 27, the back panel 29, the first side panel 31, and the second side panel 33 is such to be tapered or angled outwardly relative to the bottom panel 25 to position the respective top edges of the front panel 27, the back panel 29, the first side panel 31, and the second side panel 33 in a manner to allow the top panel 43 to fit within the top opening defined by the respective top edges. Such angled position of the front panel 27, the back panel 29, the first side panel 31, and the second side panel 33 and the wider opening formed by the top edges of the front panel 27, the back panel 29, the first side panel 31, and the second side panel 33 allows the top panel 43 to be received through the wide top opening and positioned below the respective top edges of the front panel 27, the back panel 29, the first side panel 31, and the second side panel 33 to close the carton 5 and to form the recessed top portion 9 of the carton 5. In addition, the oblique configuration of the fold lines 65, 69, 73, 77 also facilitates the positioning of the front panel 27, the back panel 29, the first side panel 31, and the second side panel 33 at respective oblique angles relative to the bottom panel 25 such that the carton 5 has a tapered configuration that facilitates nesting and/or stacking, as described further herein. The front panel 27, the back panel 29, the first side panel 31, and the second side panel 33 could be otherwise positioned (e.g., tapered or angled more or less than shown) without departing from the scope of the disclosure.

Referring additionally to FIGS. 4A and 5, a series of stacked cartons 5 is illustrated, with each carton 5 below the top carton 5 positioned to receive and support a portion of a vertically-adjacent carton 5 in a respective top recessed portion 9. In one embodiment, the bottom carton 5 can be a first carton, and the vertically-adjacent cartons 5 can be considered a second carton, a third carton, etc. In addition to the support provided by the top panel 43 of each carton 5, the upper portions of the front reinforcement panel 49 and the front panel 27, the first side reinforcement panel 55 and the first side panel 31, the second side reinforcement panel 59 and the second side panel 33, and the upper edge portions 48 of the back panel 29 that extend above the recessed top panel 43 of each carton 5 provides front-to-back and side-to-side stability, e.g., by engaging lower portions, for example, bottom corners and edges, of a respective vertically adjacent carton 5 to inhibit slidable movement thereof. In this regard, a system 13 of stacked cartons 5 is provided wherein the cartons 5 are interlocked or stabilized by the engagement of the bottom portion of a respective carton 5 with the respective recessed top portion 9 of a respective carton 5. It will be understood that in an open configuration of the carton 5, e.g., with the top panel 43 raised relative to the remainder of the carton 5, vertically adjacent cartons 5 can be nested within the interior 7 of the carton 5 therebelow, for example, to reduce space and/or to facilitate loading of the cartons 5. While a system 13 of three stacked cartons 5 is illustrated, more than three cartons 5 or less than three cartons 5 can be stacked in this manner without departing from the disclosure. In the first embodiment of FIGS. 4A and 5, the system 13 of stacked cartons 5 includes three cartons 5 shown in the stacked configuration with the first carton being the bottom carton, the second carton stacked above the first carton, and the third carton stacked above the second carton. Further, in the embodiment of FIGS. 4A and 5, all the cartons 5 of the stacked system 13 are identical in size, shape, and configuration. In other embodiments, the system 13 of cartons 5 can comprise more or less than three cartons 5, and/or one or more of the stacked cartons can be a different size, shape, and/or configuration without departing from the disclosure.

Referring to FIGS. 2 and 5, an exterior surface 101 of a handle blank 103 for forming the handle 11 (FIG. 6) for the system 13 of stacked cartons 5 is illustrated. As shown, the blank 103 includes a bottom panel 125 foldably connected to a respective front handle panel 127 and a back handle panel 129 at respective lateral fold lines 131, 133. The front handle panel 127 of the illustrated blank 103 defines an opening 135 for receiving therethrough one or more tabs 91 of respective stacked cartons 5. As illustrated, the front handle panel 127 of the blank 103 also includes an engagement feature 137 that extends into the opening 135 and has an edge 139 for engaging the tab 91 of the lowermost carton 5 of the stacked cartons 5. The blank 103, as also shown, includes a respective front top handle panel 141 and a back top handle panel 143 foldably connected to the respective front handle panel 127 and the back handle panel 129 at respective lateral fold lines 145, 147, with the fold line 145 being interrupted by the opening 135. A front handle flap 148 is foldably connected to the front top handle panel 141 at a lateral fold line 149, and includes a handle reinforcement flap 151 defined by a lateral cut 153 that interrupts the fold line 149 and that intersects an arcuate and/or oblique fold line 155. As shown, the handle reinforcement flap 151 can be positioned adjacent a pair of cutouts 150. Similarly, a back handle flap 157 is foldably connected to the back top handle panel 143 at a lateral fold line 159, and includes a handle opening 161.

Figure 6:
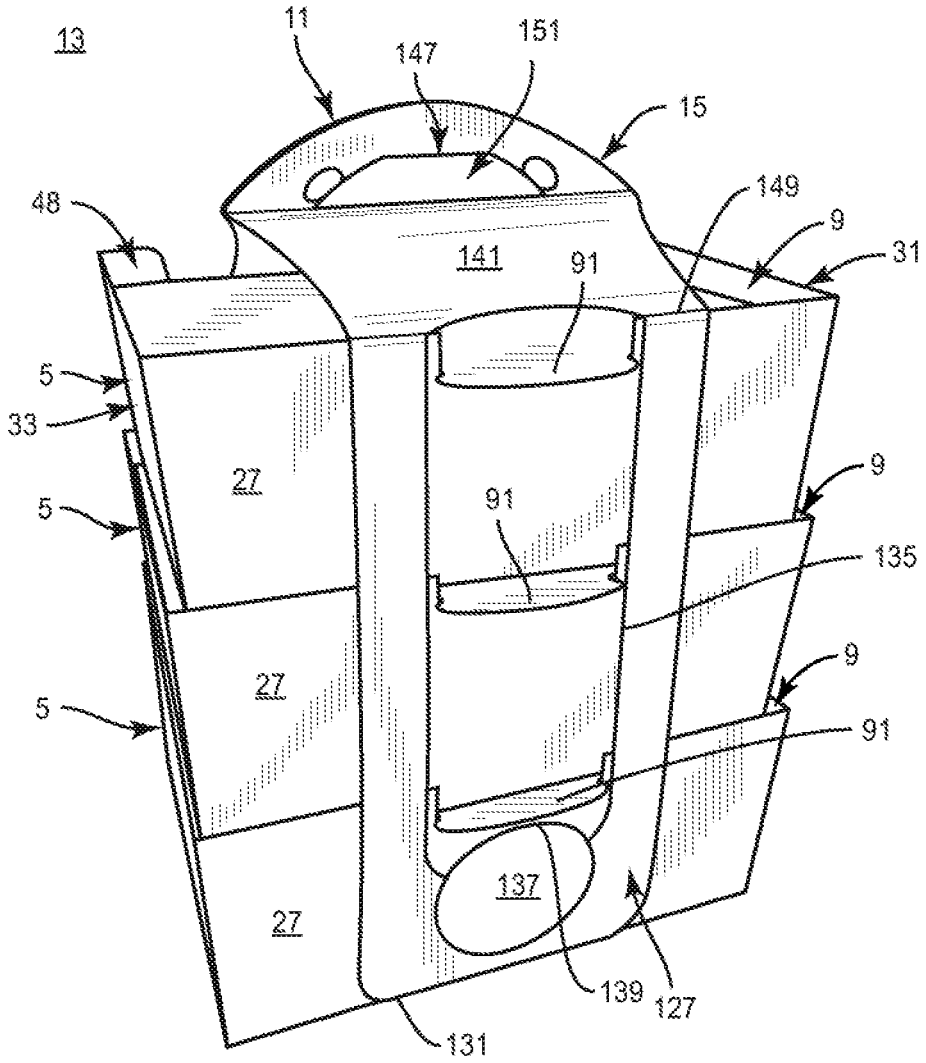
FIG. 6 is a perspective view of the system of FIG. 5 engaged by a handle formed from the blank of FIG. 2 according to the first exemplary embodiment of the disclosure.

Referring to FIGS. 2, 5, and 6, the handle blank 103 can be folded around the stacked cartons 5 to provide the handle 11 for carrying the system 13 of stacked cartons 5. In one embodiment, the bottom handle panel 125 can be positioned below and in face-to-face contact with the bottom panel 25 of the bottom carton 5 (broadly, "first carton"), with the front handle panel 127 folded upwardly at the fold line 131 into generally upright perpendicular relation with the bottom handle panel 125 of the handle 11, and with the back handle panel 129 folded upwardly at the fold line 133 into generally upright perpendicular relation with the bottom handle panel 125 of the handle 11. The front top handle panel 141, as shown, can be folded at the fold line 145 into generally oblique relation with the front handle panel 127, and the back top handle panel 143 can be folded at the fold line 147 into generally oblique relation with the back handle panel 129. In such an arrangement, the top handle flaps 148, 157 can be brought into at least partial face-to-face contact, for example, by folding at the respective fold lines 149, 159, and with the handle reinforcement flap 151 at least partially separated from the handle flap 147 at the tear line 153 to create an opening that aligns with the handle opening 161 such that the handle flaps 148, 157 together provide a handle feature 15 that can be grasped, for example, by the fingers of a user.

As also shown, the opening 135 of the front handle panel 127 of the handle 11 aligns with the tabs 91 of the stacked cartons 5, such that the tabs 91 extend through the opening 135. As also shown, the edge 139 of the engagement feature 137 of the handle 11 is positioned to contact the tab 91 of the lowermost carton 5. In this regard, the engagement feature 137 can provide stability to and maintain the arrangement of the stacked carton 5. For example, the engagement feature 137 can engage the tab 91 of the lowermost carton 5 in tension such that the stacked cartons 5 are urged together through the circumferential engagement of the handle 11 therearound.

Figure 7:
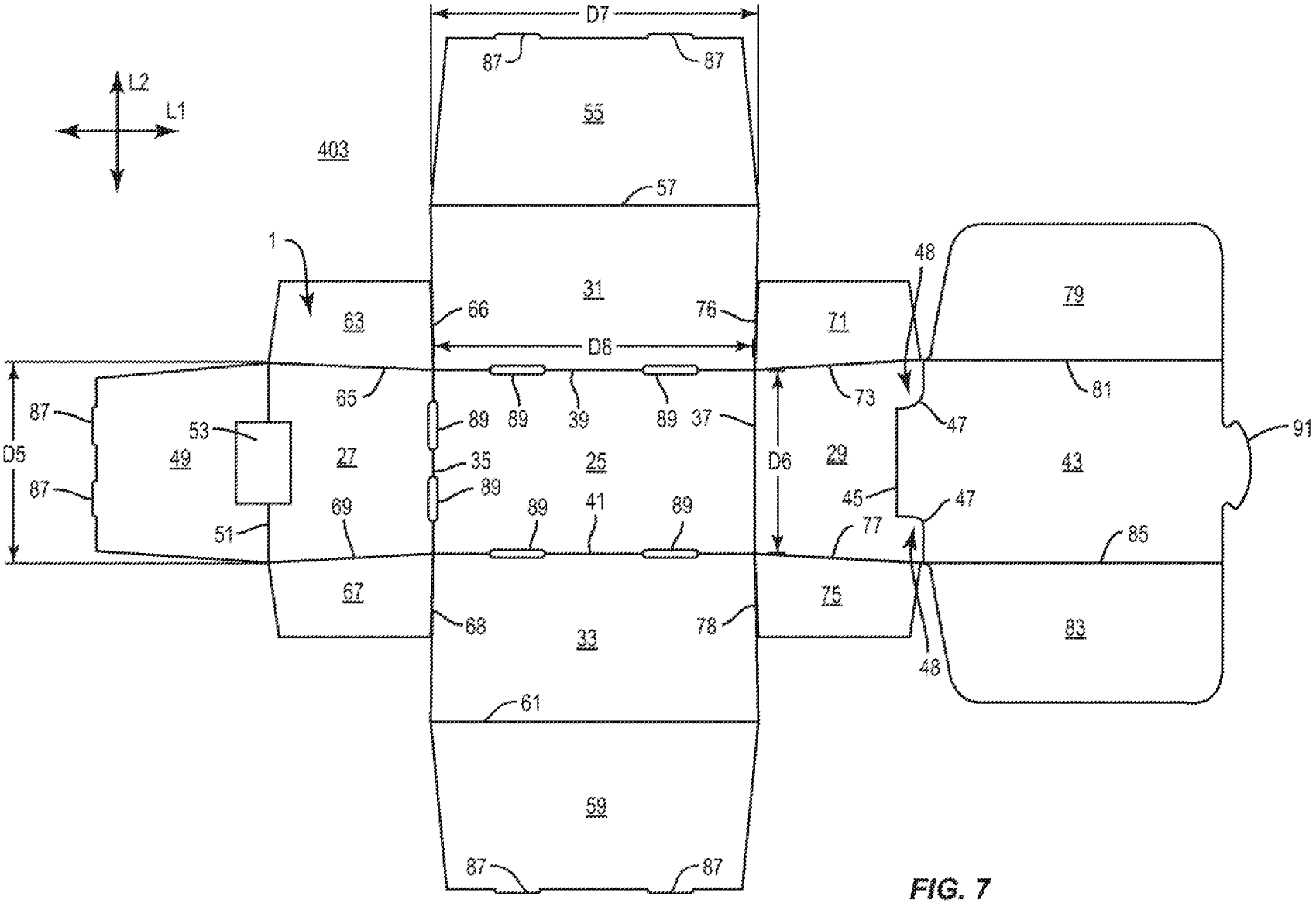
FIG. 7 is a plan view of an exterior surface of a blank for forming a carton according to a second exemplary embodiment of the disclosure.
Figure 8:
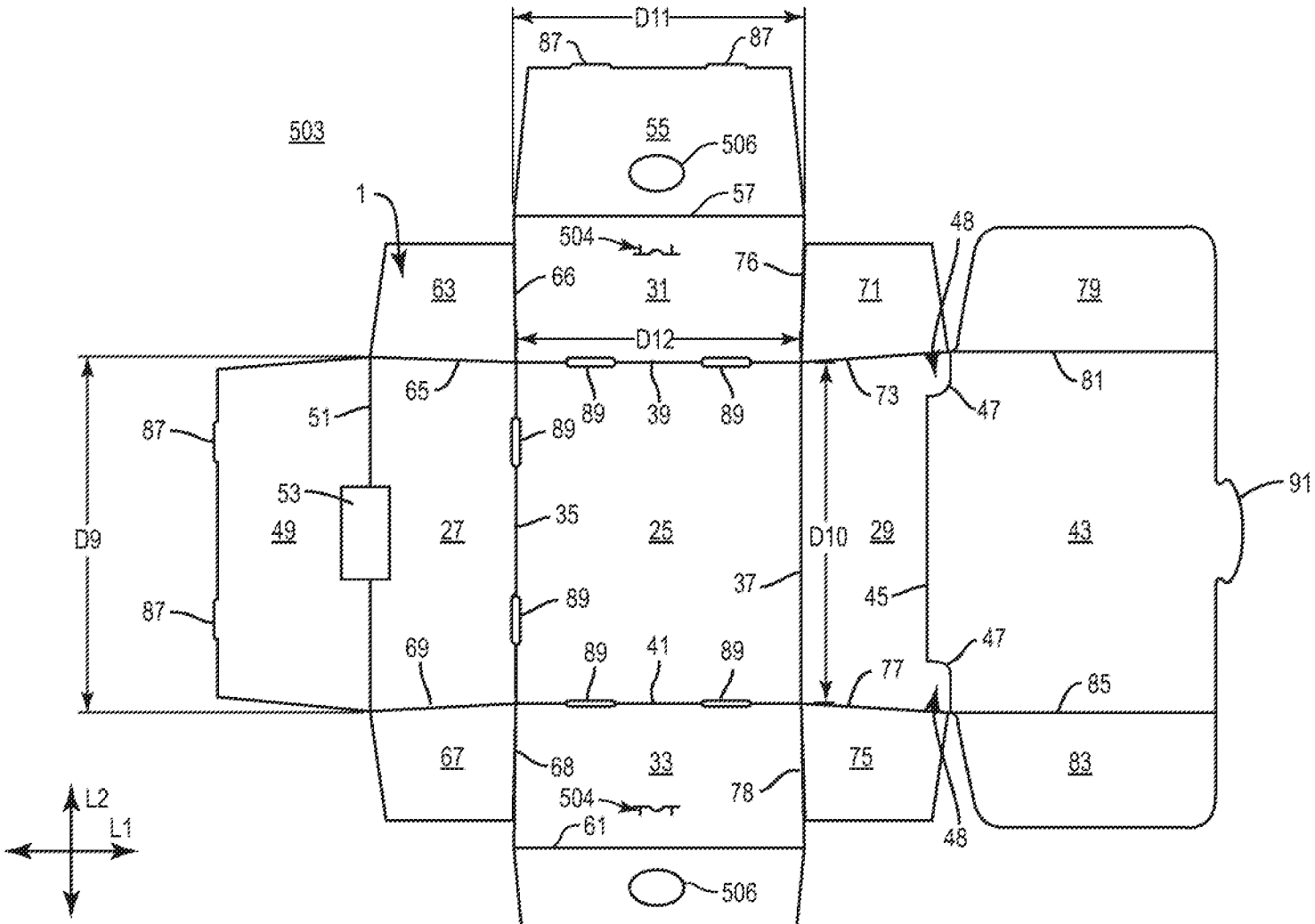
FIG. 8 is a plan view of an exterior surface of a blank for forming another carton according to the second exemplary embodiment of the disclosure
Figure 9:
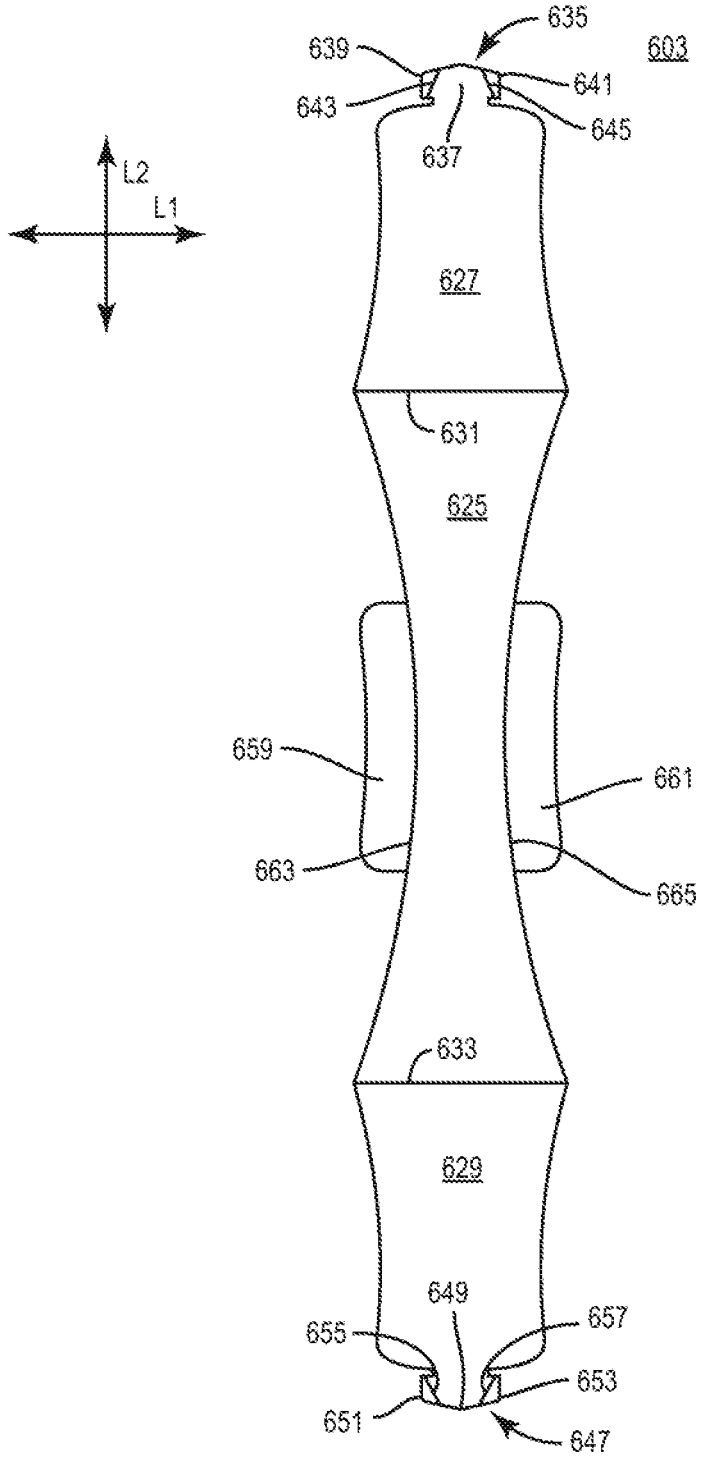
FIG. 9 is a plan view of an exterior surface of a blank for forming a handle according to the second exemplary embodiment of the disclosure.

Referring to FIGS. 7 and 8, a respective carton blank 403 and a carton blank 503 for forming respective cartons 405 and 505 (FIG. 10) according to a second exemplary embodiment of the disclosure, and FIG. 9 illustrates a handle blank 603 for forming a handle 413 (FIG. 11) according to the second exemplary embodiment of the disclosure. The blank 403, the blank 503, and the blank 603 include one or more similar features as the respective carton blank 1 (FIG. 1) and the handle blank 103 (FIG. 2) of the first exemplary embodiment of the disclosure, and like or similar elements are designated with like or similar reference numbers. In this regard, the front panel 27 and the back panel 29 of the blank 403 have respective top edges having a lateral length D5 that is greater than a lateral length D6 of the respective bottom edges thereof, and the side panels 31, 33 of the blank 403 have respective top edges having a longitudinal length D7 that is greater than a longitudinal length D8 of the respective bottom edges thereof. Similarly, the front panel 27 and the back panel 29 of the blank 503 have respective top edges each having a lateral length D9 that is greater than a lateral length D10 than the respective bottom edges thereof, and the side panels 31, 33 of the blank 503 have respective top edges having a longitudinal length D11 that is greater than a longitudinal length D12 of the respective bottom edges thereof.

As shown, the blank 503 includes notches 504 formed by a line of weakening on each of the first side panel 31 and the second side panel 33, and the blank 503 includes an aperture 506 on each of the first side reinforcement panel 55 and the second side reinforcement panel 59 that aligns with a respective notch 504 when the carton 505 is formed such that each aperture 506 provides clearance adjacent a respective notch 504.

As shown in FIG. 9, the blank 603 includes a top handle panel 625 foldably connected to a respective first side handle panel 627 and a second side handle panel 629 at respective longitudinal fold lines 631, 633. As illustrated, a locking feature 635 extends from the first side handle panel 627 and includes a tab 637 and respective first and second flaps 639, 641 foldably connected to the tab 637 at respective oblique fold lines 643, 645. Similarly, a locking feature 647 extends from the second side handle panel 629 and includes a tab 649 and respective first and second flaps 651, 653 foldably connected to the tab 649 at respective oblique fold lines 655, 657. A pair of reinforcement flaps 659, 661, as shown, can be foldably connected to the top handle panel 625 at respective fold lines 663, 665 to facilitate grasping by a user.

Figure 10:
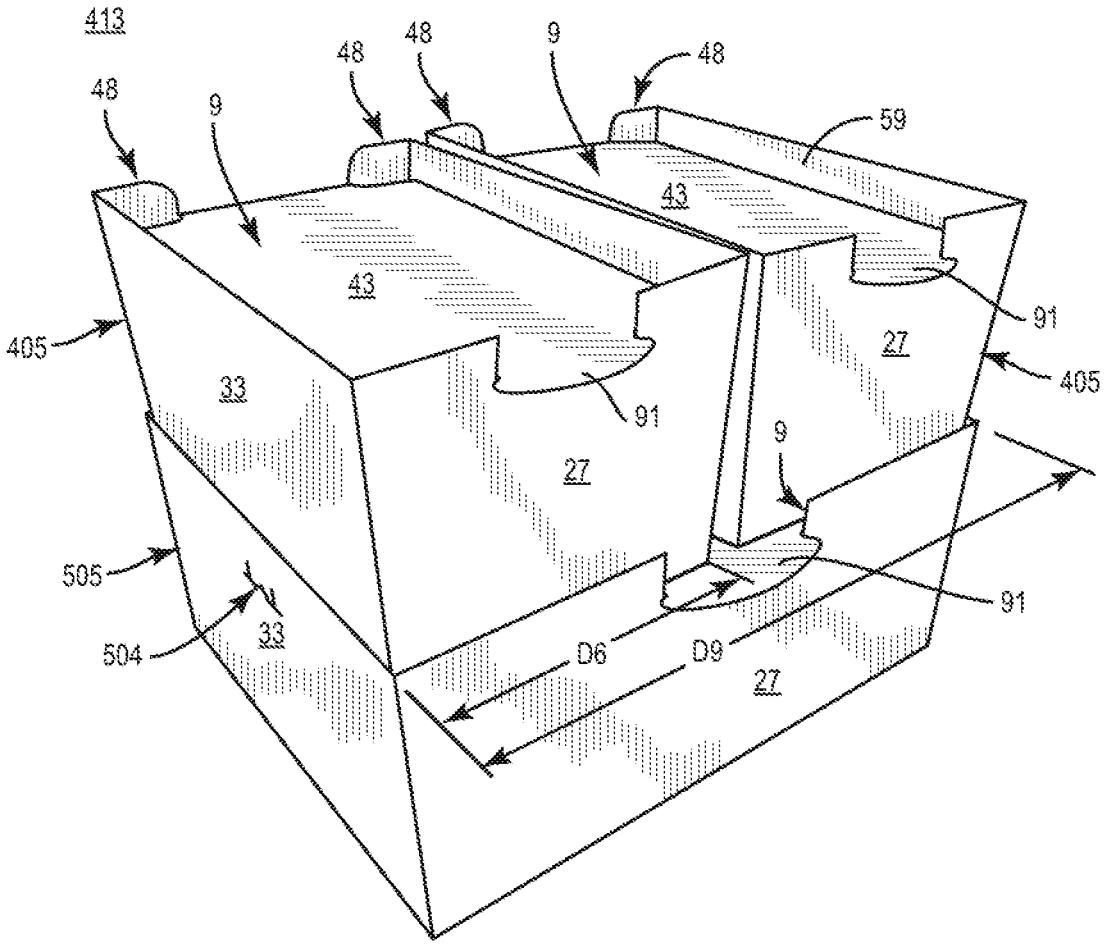
FIG. 10 is a perspective view of a system of stacked cartons formed from the blanks of FIGS. 7 and 8 according to the second exemplary embodiment of the disclosure.

Referring additionally to FIG. 10, a carton 505 formed from the blank 503 is illustrated with a pair of cartons 405 formed from respective blanks 403 stacked thereupon. In this regard, the carton 505 is configured and dimensioned with a recessed top portion 9 that can accommodate multiple cartons 405 positioned or stacked in a side-by-side arrangement. Accordingly, the length D6 of the front and back bottom edges of each of the cartons 405 is less than the length D9 of the front top edge of the carton 505 such that, in the illustrated embodiment, $2*D6<D9$. Similarly, the length D8 of the side bottom edges of each of the cartons 405 is less than the length D11 of the side top edges of the carton 505 such that, in the illustrated embodiment, $D8<D11$ (FIGS. 7 and 8).

In this regard, a system 413 can be provided in which the carton 505 is positioned as a lowermost carton 505 (broadly, "first carton", with multiple smaller cartons 405 stacked thereupon (broadly "second carton", "third carton", etc., respectively) in a side-by-side arrangement and that are positionally stabilized and maintained as described above with regard to the previous embodiments. Accordingly, engagement of portions of the cartons 405 with each other as well as upper portions of the front reinforcement panel 49 and the front panel 27, the first side reinforcement panel 55 and the first side panel 31, the second side reinforcement panel 59 and the second side panel 33, and the upper edge portions 48 of the back panel 29 inhibit slidable movement thereof. While the system 413 has been illustrated with a lowermost carton 505 and a pair of cartons 405 stacked upon the carton 505 in a side-by-side arrangement, it will be understood that more than two cartons 405 can be stacked upon the carton 505 in a side-by-side arrangement, and/or additional cartons 405 can be stacked upon the cartons 405, without departing from the disclosure. In other embodiments, a different arrangement of cartons can provide a system 413, for example, multiple stacked cartons 405 or multiple stacked cartons 505. In the second embodiment of FIGS. 10 and 11, the system 413 of stacked cartons includes three cartons 405, 505 shown in the stacked configuration with the first carton 505 being the bottom/larger carton, the second carton 405 and third carton 405 each being stacked above the first carton 505 and being smaller than the first carton. Further, in the embodiment of FIGS. 10 and 11, the two upper cartons 405 are of the stacked system 413 are identical in size, shape, and configuration. In other embodiments, the system 413 of cartons 405, 505 can comprise more or less than two upper cartons 405, and/or one or more of the upper cartons can be a different size, shape, and/or configuration without departing from the disclosure.

Figure 11:
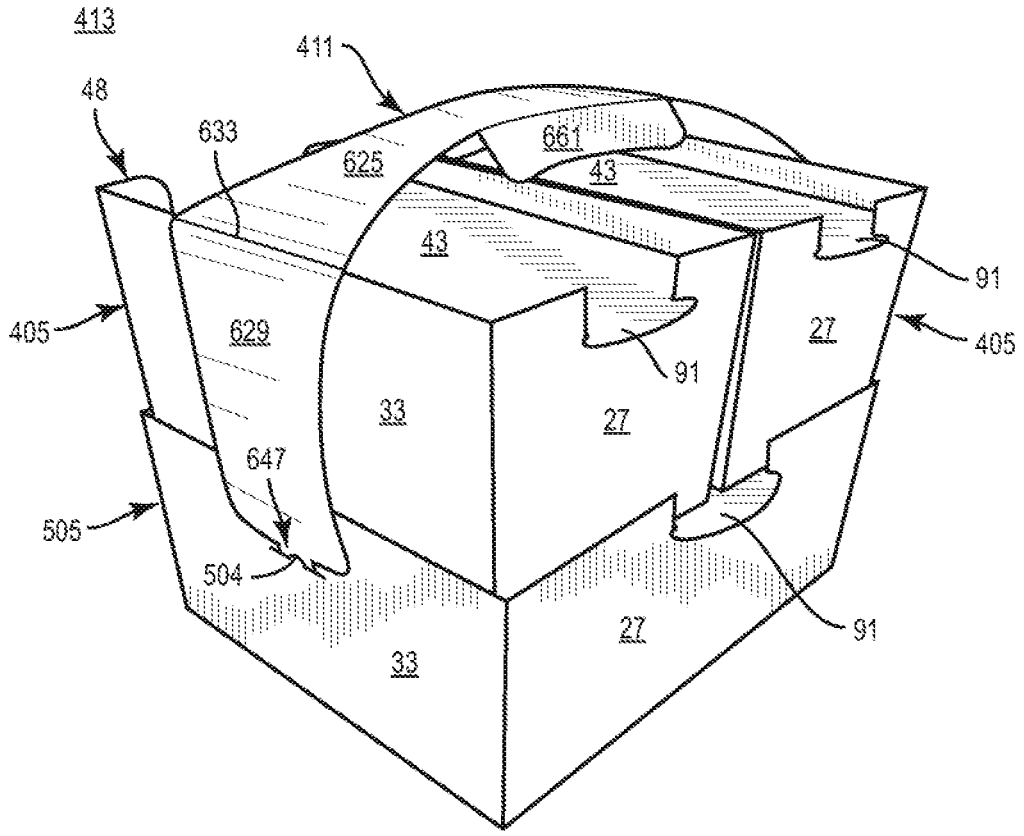
FIG. 11 is a perspective view of the system of FIG. 10 engaged by a handle formed from the blank of FIG. 9 according to the second exemplary embodiment of the disclosure.

Referring additionally to FIG. 11, the blank 603 can be folded at least partially around the stacked cartons 505, 405 to provide the handle 411 for the system 413. In one embodiment, the top handle panel 625 can be placed over the cartons 405 and the first side handle panel 627 and the second side handle panel 629 can be folded downwardly at the respective fold lines 631, 633 into generally perpendicular relation with the top handle panel 625. In such an arrangement, the locking features 635, 647 are positioned adjacent the respective notches 504 of the respective first side panel 531 and the second side panel 533 of the carton 505 such that the locking features 635, 647 can be inserted at least partially into the respective notches 504 to lock the handle 411 to the stacked cartons 505, 405. In this regard, the handle 411 can provide stability to and maintain the arrangement of the system 413 of stacked cartons 505, 405. For example, the locking features 635, 647 can engage the respective notches 504 in tension such that the stacked cartons 505, 405 are urged or compressed together.

Figure 12:
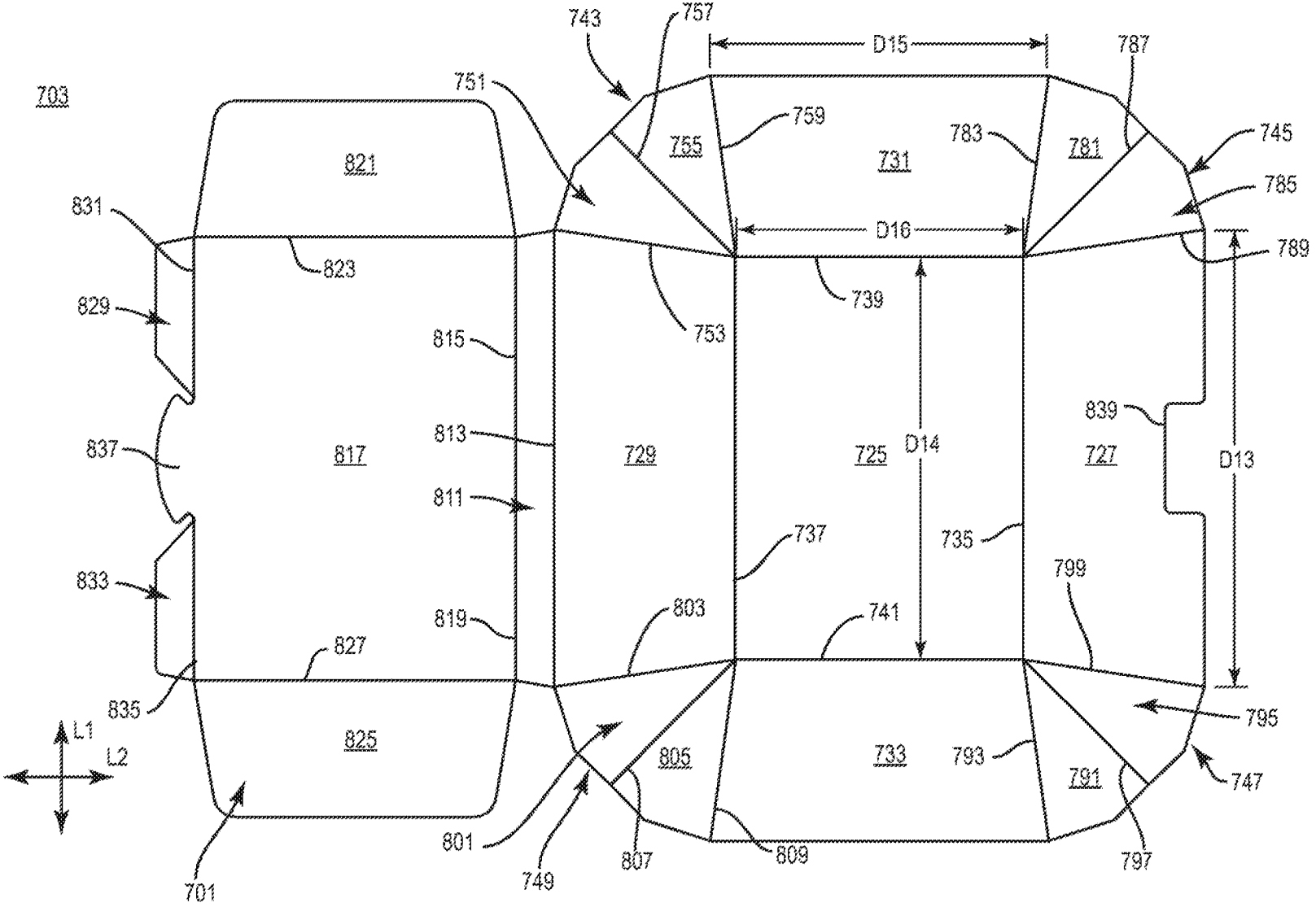
FIG. 12 is a perspective view of an exterior surface of a blank for forming a carton according to a third exemplary embodiment of the disclosure.

Turning to FIG. 12, a plan view of an exterior surface 701 of a carton blank 703 that can be obtained for forming a carton 705 (FIGS. 13-15) according to a third exemplary embodiment of the disclosure. The carton 705 has an interior 707 for holding at least one article contained therein, and is provided with a recessed top portion 709 that is configured to receive a bottom portion of a vertically stacked carton 705 to form a system 713 (FIG. 16) of multiple stacked cartons 705 similar to the systems 13, 413 (FIGS. 4A, 5, 10, and 11) described herein. In one embodiment, the system 713 of stacked cartons 705 can together be engaged by a handle, for example, the handle 11 (FIG. 6) or the handle 411 (FIG. 11) described herein. In another embodiment, the system 713 of stacked cartons 705 can be engaged and/or carried by a different structure, for example, a bag, liner, other packaging, or alternative handle, without departing from the scope of the disclosure.

As also described herein, the carton 705 is configured with a bottom receptacle 711 with a configuration that can maintain fluids in the bottom receptacle 711 and inhibit, minimize, and/or prevent the passage of fluids from the bottom receptacle 711 into the surrounding environment to provide a substantially leak-proof or leak-resistant configuration of the carton 705. In this regard, the carton 705 can be used to store and/or transport articles that contain fluids, for example, beverages, soups, condiments, dressings, etc., in a secure manner that prevents fluids in the interior 707 from readily leaking from the carton 705 during transport.

The blank 703 has the longitudinal axis L1 and a lateral axis L2, as shown, and includes a bottom panel 725 that is foldably connected to a respective front panel 727, a back panel 729, a first side panel 731, and a second side panel 733 at respective fold lines 735, 737, 739, 741, with the fold lines 735, 737 being lateral fold lines and the fold lines 739, 741 being longitudinal fold lines. The illustrated blank 703 includes a first gusset 743 foldably connected to each of the back panel 729 and the first side panel 731, a second gusset 745 foldably connected to each of the first side panel 731 and the front panel 727, a third gusset 747 foldably connected to each of the front panel 727 and the second side panel 733, and a fourth gusset 749 foldably connected to each of the second side panel 733 and the back panel 729.

The first gusset 743 includes a first gusset panel 751 foldably connected to the back panel 729 at an oblique fold line 753 and a second gusset panel 755 foldably connected to the first gusset panel 751 at an oblique fold line 757 and foldably connected to the first side panel 731 at an oblique fold line 759. The second gusset 745 includes a third gusset panel 781 foldably connected to the first side panel 731 at an oblique fold line 783 and a fourth gusset panel 785 foldably connected to the third gusset panel 781 at an oblique fold line 787 and foldably connected to the front panel 727 at an oblique fold line 789. The third gusset 747 includes a fifth gusset panel 791 foldably connected to the second side panel 733 at an oblique fold line 793 and a sixth gusset panel 795 foldably connected to the fifth gusset panel 791 at an oblique fold line 797 and foldably connected to the front panel 727 at an oblique fold line 799. The fourth gusset 749 includes a seventh gusset panel 801 foldably connected to the back panel 729 at an oblique fold line 803 and an eighth gusset panel 805 foldably connected to the seventh gusset panel 801 at an oblique fold line 807 and foldably connected to the second side panel 733 at an oblique fold line 809.

As shown, a top panel 817 is foldably connected to the back panel 729 at a longitudinal fold line 813 and a longitudinal fold line 819 adjacent the top panel 817 defines a hinge panel 811 that is foldably connected to the back panel 813 at the fold line 813 and that is foldably connected to the top panel 817 at the fold line 819. A first top end flap 821 is foldably connected to the top panel 817 at a lateral fold line 823, and a second top end flap 825 is foldably connected to the top panel 817 at a lateral fold line 827. Still referring to FIG. 12, a third top end flap 829 (broadly, "first front end flap") is foldably connected to the top panel 817 at a longitudinal fold line 831 and a fourth top end flap 833 (broadly, "second front end flap") is foldably connected to the top panel 817 at a longitudinal fold line 835. As shown, the third top end flap 829 and the fourth top end flap 833 are spaced apart, with a tab 837 of the top panel 817 protruding therebetween. A recess or cutout 839 along the free edge of the front panel 727 is configured to be engaged by or otherwise receive a portion of the tab 837, as described further herein.

Figure 13:
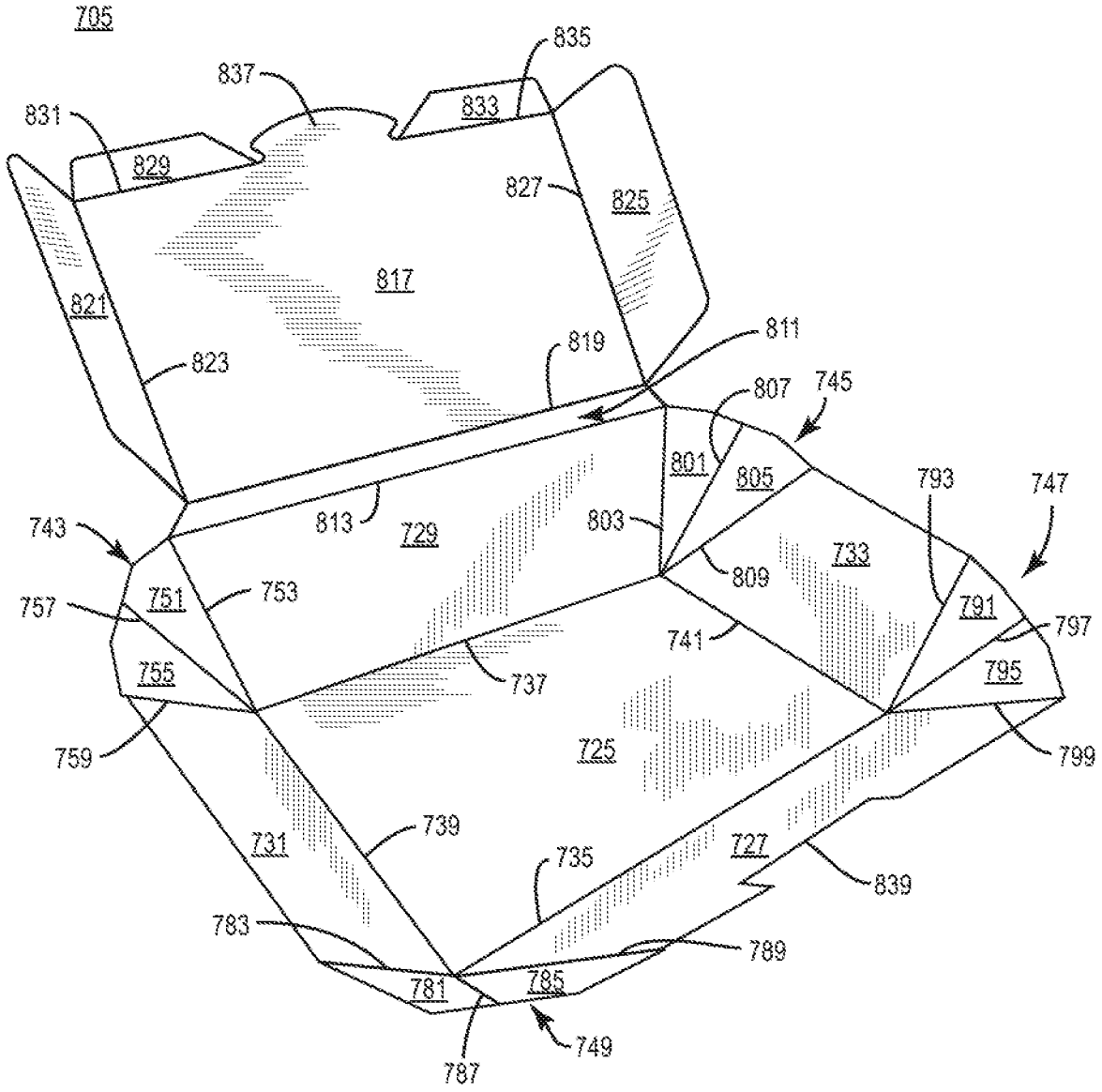
FIG. 13 is a perspective view of a partially formed carton formed from the blank of FIG. 12 according to the third exemplary embodiment of the disclosure.

Referring additionally to FIG. 13, the panels 727, 729, 731, 733 can be folded upright relative to the bottom panel 725 to partially form the interior 707 of the carton 705. In one embodiment, the front panel 727 is folded at the fold line 735 into a generally upright position relative to the bottom panel 725, the back panel 729 is folded at the fold line 737 into a generally upright position relative to the bottom panel 725, and the respective first and second side panels 731, 733 are folded at the respective fold lines 739, 741 into a generally upright position relative to the bottom panel 725. The second gusset panel 755 can be folded at the fold line 757 into at least partial face-to-face contact with an interior surface of the first gusset panel 751, and the first gusset panel 751 can be folded at the fold line 753 into at least partial face-to-face contact with an exterior surface of the back panel 729. In such an arrangement of the first gusset 743, relative folding of the second gusset panel 755 at the fold line 759 can draw the first side panel 731 into generally intersecting relation with the back panel 729.

The third gusset panel 781 can be folded at the fold line 787 into at least partial face-to-face contact with an interior surface of the fourth gusset panel 785, and the fourth gusset panel 785 can be folded at the fold line 789 into at least partial face-to-face contact with an exterior surface of the front panel 727. In such an arrangement of the second gusset 745, relative folding of the third gusset panel 781 at the fold line 783 can draw the first side panel 731 into generally intersecting relation with the front panel 727.

The fifth gusset panel 791 can be folded at the fold line 797 into at least partial face-to-face contact with an interior surface of the sixth gusset panel 795, and the sixth gusset panel 795 can be folded at the fold line 799 into at least partial face-to-face contact with an exterior surface of the front panel 727. In such an arrangement of the third gusset 747, relative folding of the fifth gusset panel 791 at the fold line 793 can draw the second side panel 733 into generally intersecting relation with the front panel 727.

The eighth gusset panel 805 can be folded at the fold line 807 into at least partial face-to-face contact with an interior surface of the seventh gusset panel 801, and the seventh gusset panel 801 can be folded at the fold line 803 into at least partial face-to-face contact with an exterior surface of the back panel 729. In such an arrangement of the fourth gusset 749, relative folding of the eighth gusset panel 805 at the fold line 809 can draw the second side panel 733 into generally intersecting relation with the back panel 729. The gussets 743, 745, 747, 749 can be maintained in the above-described arrangements with one or more adhesives, for example, glue.

As shown, the above-described arrangement of the panels 725, 727, 729, 731, 733, 817 and the gussets 743, 745, 747, 749 provides an open configuration of the carton 705 in which the interior 707 of the carton 705 is accessible, for example, to load and/or retrieve one or more articles from the interior 707 of the carton 705. As also shown, the arrangement of the first gusset 743, the first side panel 731, the second gusset 745, the front panel 727, the third gusset 747, the second side panel 733, the fourth gusset 749, and the back panel 729 provides a substantially leak-resistant bottom receptacle 711 that is substantially devoid of adhered or otherwise coupled surfaces, openings, or other discontinuities.

For example, proceeding in a clockwise order, the back panel 729, the first gusset panel 751, the second gusset panel 755, the first side panel 731, the third gusset panel 781, the fourth gusset panel 785, the front panel 727, the sixth gusset panel 795, the fifth gusset panel 791, the second side panel 733, the eighth gusset panel 805, and the seventh gusset panel 801 (all of which are foldably connected to the bottom panel 725), provide a substantially continuous surface that is joined only by respective fold lines 753, 757, 759, 783, 787, 789, 799, 797, 793, 809, 807, 803 such that the panels 729, 751, 755, 731, 781, 785, 727, 795, 791, 733, 805, 801, together with the bottom panel 725, can maintain one or more fluids in the bottom receptacle 711 and inhibit, minimize, and/or prevent the passage of such one or more fluids from the bottom receptacle 711 into the surrounding environment. In this regard, the bottom receptacle 711 provides a substantially leak-proof or leak-resistant configuration. In one embodiment, the blank 703/carton 705 can be provided with an interior liner suitable for contact with one or more fluids and arranged to inhibit, minimize, and/or prevent the passage of such one more fluids therethrough, for example, a polymeric material. Such material and/or properties can also be applied to the blank 703/carton 705 as a film, surface treatment, or coating.

Figure 14:
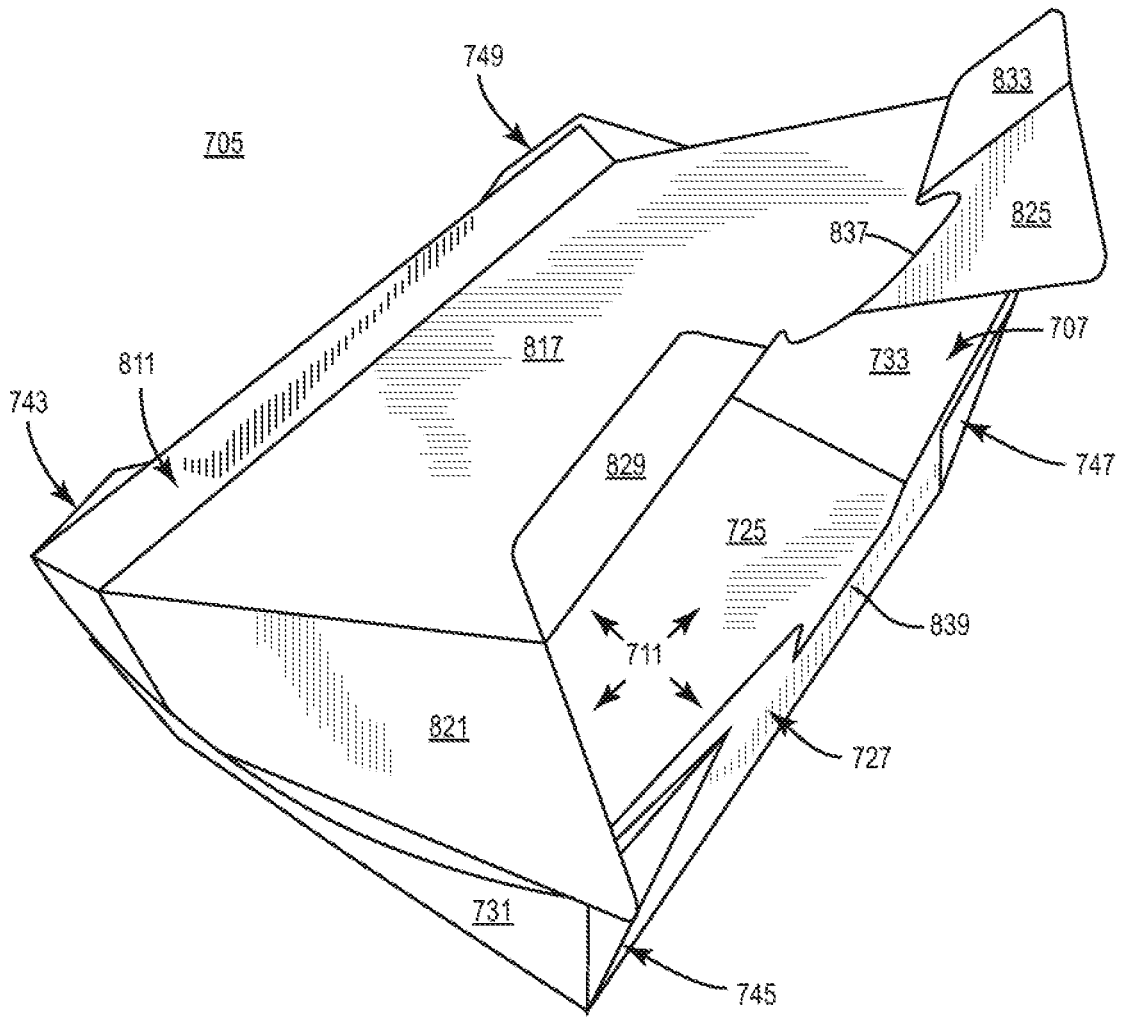
FIG. 14 is a perspective view of a carton formed from the blank of FIG. 12 in an open configuration according to the third exemplary embodiment of the disclosure.
Figure 15:
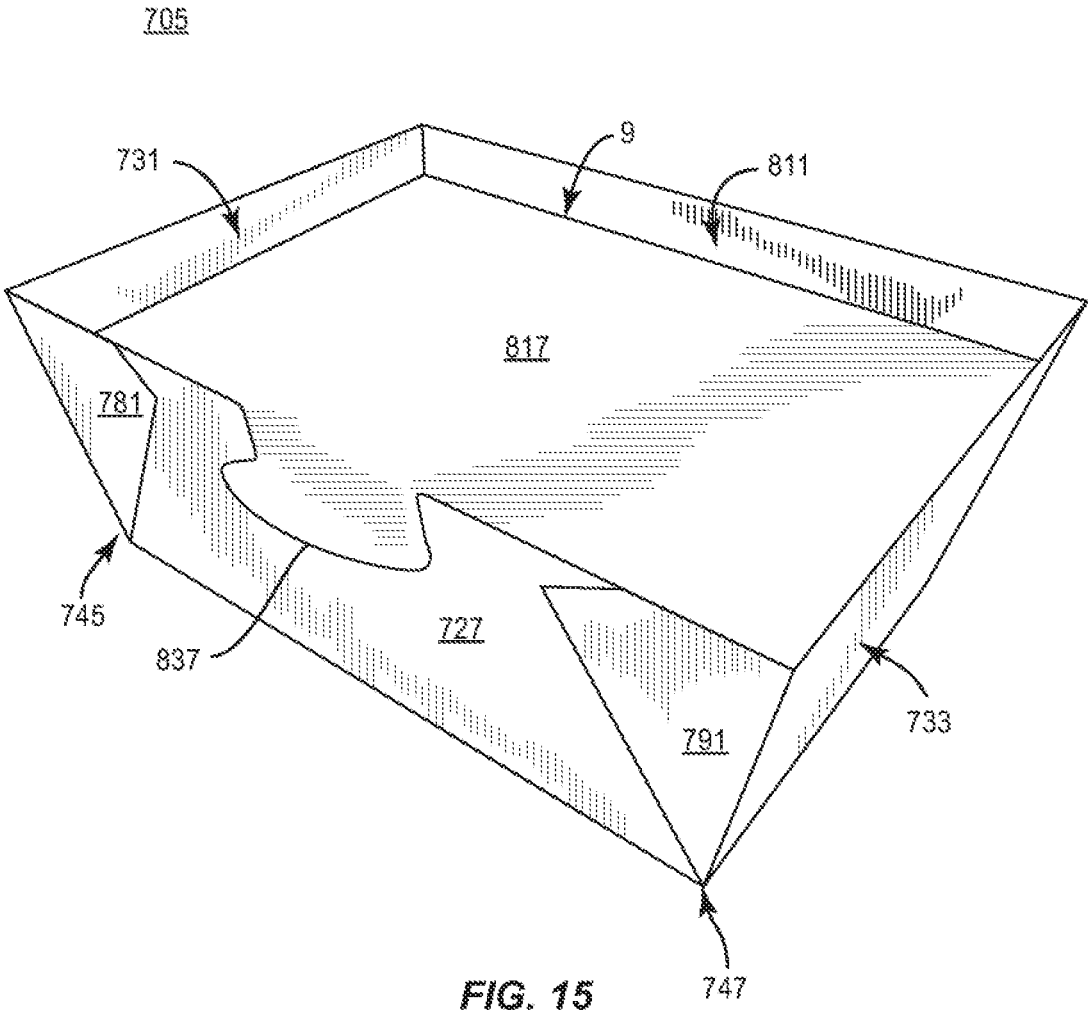
FIG. 15 is a perspective view of a carton formed from the blank of FIG. 12 in a closed configuration according to the third exemplary embodiment of the disclosure.
Figure 16:
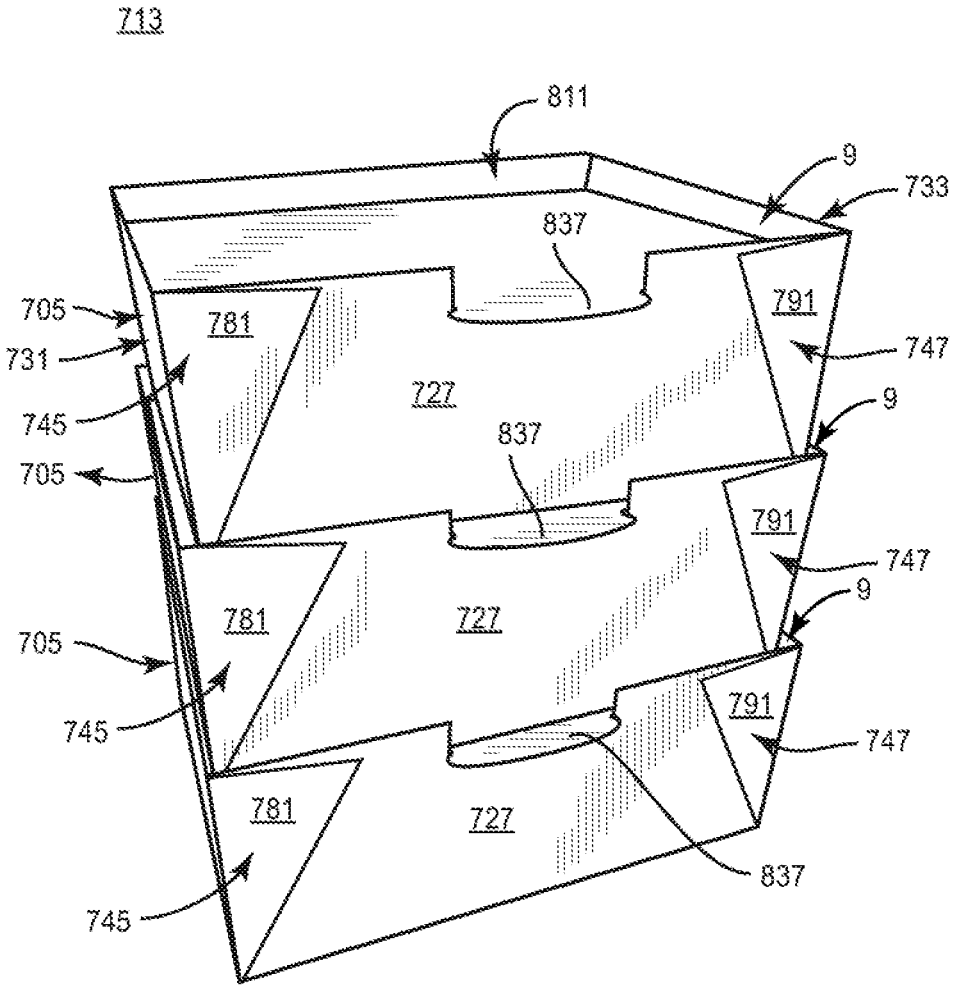
FIG. 16 is a perspective view of a system of stacked cartons formed from the blank of FIG. 12 according to the third exemplary embodiment of the disclosure.

Referring to FIGS. 14, 15, and 16, the carton 705 is provided with an openable/reclosable configuration in which the top panel 817 is hingably attached to the hinge panel 811 at the fold line 819 and positionable between a closed position (FIG. 16) wherein the top panel 817 closes the interior 707 of the carton 705, and an open position (FIG. 14) wherein the top panel 817 is raised to provide access to the interior 707. The hinge panel 811 can be folded at the fold line 813 into at least partial face-to-face contact with a portion of the back panel 729, or the hinge panel 811 can be at least partially separated from the back panel 729 to provide an articulable arrangement of the top panel 817.

In the illustrated closed configuration of the carton 5, the top panel 817 can be folded downwardly at the fold line 819 with the end flaps 821, 825 tucked into the interior 707 of the carton 705 adjacent the respective side panels 731, 733. In such an arrangement, the end flaps 829, 833 can be at least partially folded at the respective fold lines 831, 833 to rest in at least partial contact with the front panel 727, for example, to inhibit, minimize, and/or prevent the passage of one or more fluids from the bottom receptacle 711 of the carton 705 between the top panel 817 and the front panel 727. As shown, the top panel 817 is arranged with the tab 837 engaging or at least partially extending through and resting upon an edge of the cutout 839 of the front panel 727. In this regard, the tab 837 presents a protruding surface or handle for engagement by a user to open and reclose the carton 705. In one embodiment, the top panel 817 extends in generally planar relation adjacent upright upper portions of the front panel 727, the back panel 729, and the side panels 731, 733, all of which extend upwardly above the top panel 817 to define the recessed top portion 709 of the carton 705.

In the illustrated embodiment, the front panel 727, the back panel 729, the first side panel 731, and the second side panel 733 are positioned to be slightly oblique to (i.e., not perpendicular) and angled outwardly from the bottom panel 725 of the carton 705. In the carton 705 formed from the blank 703, the front panel 727 and the back panel 729 each have a top edge defined by a respective free edge thereof, and each respective top edge having a lateral length D13. The front panel 727 and the back panel 729 have respective bottom edges defined by the respective fold lines 735, 737, each having a lateral length D14 that is less than the longitudinal length D13. Further, the first side panel 731, and the second side panel 733 each have a respective top edge defined by a respective free edge thereof, and each respective top edge having a longitudinal length D15. The side panels 731, 733 have respective bottom edges formed by the respective fold lines 739, 741, each respective bottom edge having a longitudinal length D16 that is less than the lateral length D15. In this regard, the dimensions of the opening formed by the top edges of the front panel 727, the back panel 729, the first side panel 731, and the second side panel 733 is larger than the dimensions of the bottom panel 725.

The positioning of the front panel 727, the back panel 729, the first side panel 731, and the second side panel 733 is thus tapered or angled outwardly relative to the bottom panel 725 to position the respective top edges of the front panel 727, the back panel 729, the first side panel 731, and the second side panel 733 in a manner to allow the top panel 817 to fit within the opening defined by the respective top edges. Such angled position of the front panel 727, the back panel 729, the first side panel 731, and the second side panel 733 and the wider top opening formed by the respective top edges allows the top panel 781 to be received through the wide top opening and positioned below the respective top edges of the front panel 727, the back panel 729, the first side panel 731, and the second side panel 733 to form the recessed top portion 709 of the carton 705. In addition, the oblique configuration of the fold lines 753, 759, 783, 789, 793, 799, 803, 809 also facilitates the positioning of the front panel 727, the back panel 729, the first side panel 731, and the second side panel 733 to facilitate stacking and/or nesting of cartons 705, for example, wherein one or more cartons 705 are disposed in the interior space of a carton 705 therebelow. The front panel 727, the back panel 729, the first side panel 731, and the second side panel 733 could be otherwise positioned (e.g., tapered or angled more or less than shown) without departing from the scope of the disclosure.

In this regard, and as shown in FIG. 16, a system 713 of stacked cartons 705 can be provided in a similar manner as described above with regard to the system 13 of stacked cartons 5 (FIGS. 4A, 5, and 6), and the system 413 of stacked cartons 405 and 505 (FIG. 10), with each carton 705 below a top carton 705 (broadly, "first carton") receiving and supporting a portion of a vertically-adjacent carton 705 (broadly, "second carton", "third carton", etc.) in a respective top recessed portion 709 and providing support and front-to-back and side-to-side stability as described above with respect to the stacked cartons 5 and 405, 505. It will be understood that in the open configuration of the carton 705, e.g., with the top panel 817 raised relative to the remainder of the carton 705, vertically adjacent cartons 705 can be nested within the interior 707 of the carton 705, for example, to reduce space and/or to facilitate loading of the cartons 705.

While a system 413 of three stacked cartons 705 is illustrated, more than three cartons 705 or less than three cartons 705 can be stacked in this manner without departing from the disclosure. In the third embodiment of FIG. 16, the system 713 of stacked cartons 705 includes three cartons 705 shown in the stacked configuration with the first carton being the bottom carton, the second carton stacked above the first carton, and the third carton stacked above the second carton. Further, in the embodiment of FIG. 16, all the cartons 705 of the stacked system 713 are identical in size, shape, and configuration. In other embodiments, the system 713 of cartons 705 can comprise more or less than three cartons 705, and/or one or more of the stacked cartons can be a different size, shape, and/or configuration without departing from the disclosure. Further, the system 713 of stacked cartons 705 could be carried by a handle similar or identical to the handle 11 (FIG. 6) or the handle 411 (FIG. 11) described herein, or by any suitable handle. Further the system 713 of stacked cartons 705 could be carried without a handle without departing from the disclosure.

In the various illustrated embodiments, the cartons 5, 405, 505, 705 could be characterized as having as a bottom tray formed by the bottom panel and the upwardly folded side panels, front panel and back panel that cooperate to form an interior space of the tray, and a lid foldably connected to the tray. The lid can be formed by the top panel and is moveable between an open or raised position, allowing access to the tray, and a closed or lowered position closing the tray and positioning the top panel to provide support for a top carton in a series of stacked cartons. The cartons 5, 405, 505, 705 could have other features and could be otherwise shaped arranged, and/or configured without departing from the disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding at least one article, the carton comprising:

a plurality of panels extending at least partially around an interior of the carton, the plurality of panels comprising a top panel, a bottom panel, a front panel, a back panel, a first side panel, and a second side panel; and a plurality of end flaps foldably connected to a respective panel of the plurality of panels, the plurality of end flaps comprises a first top end flap and a second top end flap each foldably connected to the top panel, the top panel is recessed below a portion of each of the front panel, the back panel, the first side panel, and the second side panel to form a recessed top portion for receiving a portion of a vertically adjacent carton, the recessed top portion defining a top opening larger than the bottom panel, the first top end flap is positioned adjacent the first side panel in the interior of the carton and the second top end flap is positioned adjacent the second side panel in the interior of the carton.

2. The carton of claim 1, further comprising a hinge panel foldably connected to the top panel and the back panel.

3. The carton of claim 1, wherein the carton comprises at least one gusset.

4. The carton of claim 3, wherein the at least one gusset comprises a first gusset panel foldably connected to a second gusset panel.

5. The carton of claim 4, wherein the at least one gusset is a first gusset foldably connected to each of the first side panel and the back panel, and the carton further comprises a second gusset foldably connected to each of the first side panel and the front panel, a third gusset foldably connected to each of the second side panel and the front panel, and a fourth gusset foldably connected to each of the second side panel and the back panel.

6. The carton of claim 5, wherein the bottom panel, the first gusset, the first side panel, the second gusset, the front panel, the third gusset, the second side panel, the fourth gusset, and the back panel are arranged to form a bottom receptacle of the carton with a substantially continuous surface for inhibiting passage of fluids from the interior of the carton to a surrounding environment.

7. The carton of claim 1 in combination with a handle engaged with the carton.

8. The combination of claim 7, wherein the handle extends over at least the top panel of the carton.

9. The combination of claim 8, wherein the handle comprises a front handle panel, a back handle panel, and a bottom handle panel foldably connected to each of the front handle panel and the back handle panel.

10. The combination of claim 9, further comprising a front top handle panel foldably connected to the front handle panel, a back top handle panel foldably connected to the back handle panel, a front handle flap foldably connected to the front top handle panel, and a back handle flap foldably connected to the back top handle panel.

11. The combination of claim 9, wherein the top panel comprises a tab, and the front handle panel comprises an opening for receiving the tab.

12. The combination of claim 8, wherein the handle comprises a top handle panel, and a first side handle panel and a second side handle panel each foldably connected to the top handle panel.

13. The combination of claim 12, wherein the handle comprises at least one locking feature extending from at least one of the first side handle panel and the second side handle panel, the at least one locking feature at least partially inserted through a notch in at least one of the first side panel and the second side panel of the carton.

14. The carton of claim 1, wherein the front panel, the back panel, the first side panel, and the second side panel are each foldably connected to the bottom panel.

15. A carton for holding at least one article, the carton comprising:

a plurality of panels extending at least partially around an interior of the carton, the plurality of panels comprising a top panel, a bottom panel, a front panel, a back panel, a first side panel, a second side panel, a front reinforcement panel foldably connected to the front panel, a first side reinforcement panel foldably connected to the first side panel, and a second side reinforcement panel foldably connected to the second side panel; and a plurality of end flaps foldably connected to a respective panel of the plurality of panels, the plurality of end flaps comprises a first top end flap and a second top end flap each foldably connected to the top panel, the top panel is recessed below a portion of each of the front panel, the back panel, the first side panel, and the second side panel to form a recessed top portion for receiving a portion of a vertically adjacent carton, the first top end flap is positioned adjacent the first side panel in the interior of the carton and the second top end flap is positioned adjacent the second side panel in the interior of the carton, an opening is formed in a portion of the front panel and a portion of the front reinforcement panel, and the top panel comprises a tab that engages the opening.

16. The carton of claim 15, wherein at least one of the front reinforcement panel, the first side reinforcement panel, and the second side reinforcement panel includes at least one locking tab, the at least one locking tab extends through a respective slit in the bottom panel.

17. A carton blank for forming a carton for holding at least one article, the carton blank comprising:

a plurality of panels for extending at least partially around an interior of the carton formed from the carton blank, the plurality of panels comprising a top panel, a bottom panel, a front panel, a back panel, a first side panel, and a second side panel;

a plurality of end flaps foldably connected to a respective panel of the plurality of panels, the plurality of end flaps comprises a first top end flap and a second top end flap each foldably connected to the top panel, the top panel is positionable below a portion of each of the front panel, the back panel, the first side panel, and the second side panel to form a recessed top portion of the carton formed from the carton blank for receiving a portion of a vertically adjacent carton and such that a top opening defined by the recessed top portion of the carton formed from the carton blank is larger than the bottom panel, the first top end flap is for being positioned adjacent the first side panel in the interior of the carton formed from the carton blank and the second top end flap is for being positioned adjacent the second side panel in the interior of the carton formed from the carton blank.

18. The carton blank of claim 17, further comprising a hinge panel foldably connected to the top panel and the back panel.

19. The carton blank of claim 17, wherein the carton comprises at least one gusset.

20. The carton blank of claim 19, wherein the at least one gusset comprises a first gusset panel foldably connected to a second gusset panel.

21. The carton blank of claim 20, wherein the at least one gusset is a first gusset foldably connected to each of the first side panel and the back panel, and the carton blank further comprises a second gusset foldably connected to each of the first side panel and the front panel, a third gusset foldably connected to each of the second side panel and the front panel, and a fourth gusset foldably connected to each of the second side panel and the back panel.

22. The carton blank of claim 21, wherein the bottom panel, the first gusset, the first side panel, the second gusset, the front panel, the third gusset, the second side panel, the fourth gusset, and the back panel are for being arranged to form a bottom receptacle with a substantially continuous surface for inhibiting passage of fluids from the interior of the carton formed from the carton blank to an environment surrounding the carton formed from the carton blank.

23. The carton blank of claim 17 in combination with a handle blank for forming a handle for engaging the carton formed from the carton blank.

24. The combination of claim 23, wherein the handle blank comprises a front handle panel, a back handle panel, and a bottom handle panel foldably connected to each of the front handle panel and the back handle panel.

25. The combination of claim 24, further comprising a front top handle panel foldably connected to the front handle panel, a back top handle panel foldably connected to the back handle panel, a front handle flap foldably connected to the front top handle panel, and a back handle flap foldably connected to the back top handle panel.

26. The combination of claim 24, wherein the top panel of the carton blank comprises a tab, and the front handle panel comprises an opening for receiving the tab in the carton formed from the carton blank.

27. The combination of claim 23, wherein the handle blank comprises a top handle panel, and a first side handle panel and a second side handle panel each foldably connected to the top handle panel.

28. The combination of claim 27, wherein the handle blank comprises at least one locking feature extending from at least one of the first side handle panel and the second side handle panel, the at least one locking feature is for being at least partially inserted through a notch in at least one of the first side panel and the second side panel of the carton formed from the carton blank.

29. The blank of claim 17, wherein the front panel, the back panel, the first side panel, and the second side panel are each foldably connected to the bottom panel.

30. A carton blank for forming a carton for holding at least one article, the carton blank comprising:

a plurality of panels for extending at least partially around an interior of the carton formed from the carton blank, the plurality of panels comprising a top panel, a bottom panel, a front panel, a back panel, a first side panel, a second side panel, a front reinforcement panel foldably connected to the front panel, a first side reinforcement panel foldably connected to the first side panel, and a second side reinforcement panel foldably connected to the second side panel;

a plurality of end flaps foldably connected to a respective panel of the plurality of panels, the plurality of end flaps comprises a first top end flap and a second top end flap each foldably connected to the top panel, the top panel is positionable below a portion of each of the front panel, the back panel, the first side panel, and the second side panel to form a recessed top portion of the carton formed from the carton blank for receiving a portion of a vertically adjacent carton, the first top end flap is for being positioned adjacent the first side panel in the interior of the carton formed from the carton blank and the second top end flap is for being positioned adjacent the second side panel in the interior of the carton formed from the carton blank, an opening is formed in a portion of the front panel and a portion of the front reinforcement panel, and the top panel comprises a tab for engaging the opening in the carton formed from the carton blank.

31. The carton blank of claim 30, wherein at least one of the front reinforcement panel, the first side reinforcement panel, and the second side reinforcement panel includes at least one locking tab, the bottom panel comprises at least one slit, the at least one locking tab is for extending through a respective slit in the bottom in the carton formed from the carton blank.

32. A method of forming a carton for holding at least one article, the method comprising:

obtaining a carton blank comprising a plurality of panels comprising a top panel, a bottom panel, a front panel, a back panel, a first side panel, and a second side panel, the carton blank comprising a plurality of end flaps foldably connected to a respective panel of the plurality of panels, the plurality of end flaps comprising a first top end flap and a second top end flap each foldably connected to the top panel;

folding the plurality of panels at least partially around an interior of the carton such that the top panel is recessed below a portion of each of the front panel, the back panel, the first side panel, and the second side panel to form a recessed top portion for receiving a portion of a vertically adjacent carton and such that a top opening defined by the recessed top portion is larger than the bottom panel; and folding the plurality of end flaps so that the first top end flap is positioned adjacent the first side panel in the interior of the carton and so that the second top end flap is positioned adjacent the second side panel in the interior of the carton.

33. The method of claim 32, further comprising a hinge panel foldably connected to the top panel and the back panel.

34. The method of claim 32, wherein the carton comprises at least one gusset.

35. The method of claim 34, wherein the at least one gusset comprises a first gusset panel foldably connected to a second gusset panel.

36. The method of claim 35, wherein the at least one gusset is a first gusset foldably connected to each of the first side panel and the back panel, and the carton further comprises a second gusset foldably connected to each of the first side panel and the front panel, a third gusset foldably connected to each of the second side panel and the front panel, and a fourth gusset foldably connected to each of the second side panel and the back panel.

37. The method of claim 36, wherein the bottom panel, the first gusset, the first side panel, the second gusset, the front panel, the third gusset, the second side panel, the fourth gusset, and the back panel are arranged to form a bottom receptacle of the carton with a substantially continuous surface for inhibiting passage of fluids from the interior of the carton to a surrounding environment.

38. The method of claim 32, further comprising engaging a handle with the carton.

39. The method of claim 38, wherein the handle extends over at least the top panel of the carton.

40. The method of claim 39, wherein the handle comprises a front handle panel, a back handle panel, and a bottom handle panel foldably connected to each of the front handle panel and the back handle panel.

41. The method of claim 40, further comprising a front top handle panel foldably connected to the front handle panel, a back top handle panel foldably connected to the back handle panel, a front handle flap foldably connected to the front top handle panel, and a back handle flap foldably connected to the back top handle panel.

42. The method of claim 40, wherein the top panel of the carton comprises a tab, and the front handle panel comprises an opening for receiving the tab.

43. The method of claim 39, wherein the handle comprises a top handle panel, and a first side handle panel and a second side handle panel each foldably connected to the top handle panel.

44. The method of claim 43, wherein the handle comprises at least one locking feature extending from at least one of the first side handle panel and the second side handle panel, the at least one locking feature at least partially inserted through a notch in at least one of the first side panel and the second side panel of the carton.

45. The method of claim 32, wherein the front panel, the back panel, the first side panel, and the second side panel are each foldably connected to the bottom panel.

46. A method of forming a carton for holding at least one article, the method comprising:

obtaining a carton blank comprising a plurality of panels comprising a top panel, a bottom panel, a front panel, a back panel, a first side panel, a second side panel, a front reinforcement panel foldably connected to the front panel, a first side reinforcement panel foldably connected to the first side panel, and a second side reinforcement panel foldably connected to the second side panel, the carton blank comprising a plurality of end flaps foldably connected to a respective panel of the plurality of panels, the plurality of end flaps comprising a first top end flap and a second top end flap each foldably connected to the top panel, an opening is formed in a portion of the front panel and a portion of the front reinforcement panel, and the top panel comprises a tab for engaging the opening;

folding the plurality of panels at least partially around an interior of the carton such that the top panel is recessed below a portion of each of the front panel, the back panel, the first side panel, and the second side panel to form a recessed top portion for receiving a portion of a vertically adjacent carton; and folding the plurality of end flaps so that the first top end flap is positioned adjacent the first side panel in the interior of the carton and so that the second top end flap is positioned adjacent the second side panel in the interior of the carton.

47. The method of claim 46, wherein at least one of the front reinforcement panel, the first side reinforcement panel, and the second side reinforcement panel includes at least one locking tab, the at least one locking tab extends through a respective slit in the bottom panel.

48. A system of cartons for holding at least one article, the system comprising:

a first carton, comprising:

a plurality of panels extending at least partially around an interior of the first carton, the plurality of panels comprising a top panel, a bottom panel, a front panel, a back panel, a first side panel, and a second side panel;

a plurality of end flaps foldably connected to a respective panel of the plurality of panels and comprising a first top end flap and a second top end flap each foldably connected to the top panel, the top panel is recessed below a portion of each of the front panel, the back panel, the first side panel, and the second side panel to form a recessed top portion, the first top end flap is positioned adjacent the first side panel in the interior of the first carton and the second top end flap is positioned adjacent the second side panel in the interior of the first carton, a top opening defined by the recessed top portion is larger than the bottom panel; and a second carton at least partially disposed in the recessed top portion of the first carton.

49. The system of claim 48, further comprising a hinge panel foldably connected to the top panel and the back panel.

50. The system of claim 48, wherein the first carton comprises at least one gusset.

51. The system of claim 50, wherein the at least one gusset comprises a first gusset panel foldably connected to a second gusset panel.

52. The system of claim 51, wherein the at least one gusset is a first gusset foldably connected to each of the first side panel and the back panel, and the first carton further comprises a second gusset foldably connected to each of the first side panel and the front panel, a third gusset foldably connected to each of the second side panel and the front panel, and a fourth gusset foldably connected to each of the second side panel and the back panel.

53. The system of claim 52, wherein the bottom panel, the first gusset, the first side panel, the second gusset, the front panel, the third gusset, the second side panel, the fourth gusset, and the back panel are arranged to form a bottom receptacle of the first carton with a substantially continuous surface for inhibiting passage of fluids from the interior of the first carton to a surrounding environment.

54. The system of claim 48, further comprising a handle engaged with the first carton.

55. The system of claim 54, wherein the handle extends over at least a top panel of the second carton.

56. The system of claim 55, wherein the handle comprises a front handle panel, a back handle panel, and a bottom handle panel foldably connected to each of the front handle panel and the back handle panel.

57. The system of claim 56, further comprising a front top handle panel foldably connected to the front handle panel, a back top handle panel foldably connected to the back handle panel, a front handle flap foldably connected to the front top handle panel, and a back handle flap foldably connected to the back top handle panel.

58. The system of claim 56, wherein the top panel of the first carton comprises a tab, and the front handle panel comprises an opening for receiving the tab.

59. The system of claim 55, wherein the handle comprises a top handle panel, and a first side handle panel and a second side handle panel each foldably connected to the top handle panel.

60. The system of claim 59, wherein the handle comprises at least one locking feature extending from at least one of the first side handle panel and the second side handle panel, the at least one locking feature at least partially inserted through a notch in at least one of the first side panel and the second side panel of the first carton.

61. The system of claim 48, wherein the second carton is smaller than the first carton.

62. The system of claim 61, further comprising a third carton at least partially disposed in the recessed top portion of the first carton.

63. The system of claim 48, wherein the front panel, the back panel, the first side panel, and the second side panel are each foldably connected to the bottom panel.

64. A system of cartons for holding at least one article, the system comprising:

a first carton, comprising:

a plurality of panels extending at least partially around an interior of the first carton, the plurality of panels comprising a top panel, a bottom panel, a front panel, a back panel, a first side panel, a second side panel, a front reinforcement panel foldably connected to the front panel, a first side reinforcement panel foldably connected to the first side panel, and a second side reinforcement panel foldably connected to the second side panel, an opening is formed in a portion of the front panel and a portion of the front reinforcement panel, and the top panel comprises a tab for engaging the opening;

a plurality of end flaps foldably connected to a respective panel of the plurality of panels and comprising a first top end flap and a second top end flap each foldably connected to the top panel, the top panel is recessed below a portion of each of the front panel, the back panel, the first side panel, and the second side panel to form a recessed top portion, the first top end flap is positioned adjacent the first side panel in the interior of the first carton and the second top end flap is positioned adjacent the second side panel in the interior of the first carton; and a second carton at least partially disposed in the recessed top portion of the first carton.

65. The system of claim 64, wherein at least one of the front reinforcement panel, the first side reinforcement panel, and the second side reinforcement panel includes at least one locking tab, the at least one locking tab extends through a respective slit in the bottom panel.

66. A system of cartons for holding at least one article, the system comprising:

a first carton, comprising:

a plurality of panels extending at least partially around an interior of the first carton, the plurality of panels comprising a top panel, a bottom panel, a front panel, a back panel, a first side panel, and a second side panel;

a plurality of end flaps foldably connected to a respective panel of the plurality of panels and comprising a first top end flap and a second top end flap each foldably connected to the top panel, the top panel is recessed below a portion of each of the front panel, the back panel, the first side panel, and the second side panel to form a recessed top portion, the first top end flap is positioned adjacent the first side panel in the interior of the first carton and the second top end flap is positioned adjacent the second side panel in the interior of the first carton; and a second carton at least partially disposed in the recessed top portion of the first carton, the second carton comprises a plurality of panels extending at least partially around an interior of the second carton, the plurality of panels of the second carton comprising a top panel, a bottom panel, a front panel, a back panel, and at least one side panel, and the top panel of the second carton is recessed below a portion of each of the front panel, the back panel, and the at least one side panel of the second carton to form a recessed top portion of the second carton.

67. A system of cartons for holding at least one article, the system comprising:

a first carton, comprising:

a plurality of panels extending at least partially around an interior of the first carton, the plurality of panels comprising a top panel, a bottom panel, a front panel, a back panel, a first side panel, and a second side panel;

a plurality of end flaps foldably connected to a respective panel of the plurality of panels and comprising a first top end flap and a second top end flap each foldably connected to the top panel, the top panel is recessed below a portion of each of the front panel, the back panel, the first side panel, and the second side panel to form a recessed top portion, the first top end flap is positioned adjacent the first side panel in the interior of the first carton and the second top end flap is positioned adjacent the second side panel in the interior of the first carton; and a second carton at least partially disposed in the recessed top portion of the first carton, the second carton is identical to the first carton.

68. The system of claim 67, further comprising a third carton at least partially disposed in a recessed top portion of the second carton.

* * * * *